US007696957B2

(12) United States Patent
Itakura

(10) Patent No.: US 7,696,957 B2
(45) Date of Patent: Apr. 13, 2010

(54) DRIVING METHOD OF PLASMA DISPLAY PANEL

(75) Inventor: Shunsuke Itakura, Chuo (JP)

(73) Assignee: Panasonic Corporation, Osaka (JP)

( * ) Notice: Subject to any disclaimer, the term of this patent is extended or adjusted under 35 U.S.C. 154(b) by 569 days.

(21) Appl. No.: 11/730,887

(22) Filed: Apr. 4, 2007

(65) Prior Publication Data

US 2007/0241995 A1 Oct. 18, 2007

(30) Foreign Application Priority Data

Apr. 13, 2006 (JP) ..... 2006-110990

(51) Int. Cl.
*G09G 3/28* (2006.01)

(52) U.S. Cl. ..... 345/60; 348/66

(58) Field of Classification Search ..... 524/458, 524/523, 527; 525/85, 80, 227, 239; 345/37, 345/60–68; 315/169.4
See application file for complete search history.

(56) References Cited

U.S. PATENT DOCUMENTS 5,854,540 A * 12/1998 Matsumoto et al. ..... 315/169.1
6,160,529 A * 12/2000 Asao et al. ..... 345/60
7,355,568 B2 * 4/2008 Homma ..... 345/60
7,583,240 B2 * 9/2009 Yamashita et al. ..... 345/60

FOREIGN PATENT DOCUMENTS

JP 2001-312244 A 11/2001
JP 2005-266743 A 9/2005

OTHER PUBLICATIONS

Korean Office Action issued Mar. 20, 2008 in Korean Patent Application No. 9-5-2008-015341514.

* cited by examiner

*Primary Examiner*—Richard Hjerpe
*Assistant Examiner*—Mansour M Said
(74) *Attorney, Agent, or Firm*—Sughrue Mion, PLLC

(57) ABSTRACT

To provide a driving method of a plasma display panel capable of improving a dark contrast while preventing a spurious discharge. A discharge is produced in discharge cells only in an address erasing process for one subfield selected from a plurality of subfields constituting a unit display period, so that the states of the discharge cells are changed to a non-light emitting state. An address writing process for producing a discharge in the discharge cells so as to set the discharge cells to a light emitting state is performed before the address erasing process in the first one of the subfields. In this case, in either of the address writing process and the address erasing process, the discharge is produced between one of the row electrode pairs and the column electrodes by supplying a voltage for charging the column electrodes to a negative polarity between the one of the row electrode pairs and the column electrodes.

14 Claims, 26 Drawing Sheets

FIG. 9

| GRADATION LEVEL | DATA CONVERSION TABLE FOR SECOND DATA CONVERSION CIRCUIT 34 | | | | | | | | | | | | | | | LIGHT EMISSION DRIVING PATTERN IN ONE FIELD | | | | | | | | | | | | | | DISPLAY LUMINANCE |
|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1 | 0000 | 1 | 0 | 0 | 0 | 0 | 0 | 0 | 0 | 0 | 0 | 0 | 0 | 0 | 0 | | | | | | | | | | | | | | | 0 |
| 2 | 0001 | 0 | 1 | 0 | 0 | 0 | 0 | 0 | 0 | 0 | 0 | 0 | 0 | 0 | 0 | ◎ | ● | | | | | | | | | | | | | 1 |
| 3 | 0010 | 0 | 0 | 1 | 0 | 0 | 0 | 0 | 0 | 0 | 0 | 0 | 0 | 0 | 0 | ◎ | ○ | ● | | | | | | | | | | | | 4 |
| 4 | 0011 | 0 | 0 | 0 | 1 | 0 | 0 | 0 | 0 | 0 | 0 | 0 | 0 | 0 | 0 | ◎ | ○ | ○ | ● | | | | | | | | | | | 9 |
| 5 | 0100 | 0 | 0 | 0 | 0 | 1 | 0 | 0 | 0 | 0 | 0 | 0 | 0 | 0 | 0 | ◎ | ○ | ○ | ○ | ● | | | | | | | | | | 17 |
| 6 | 0101 | 0 | 0 | 0 | 0 | 0 | 1 | 0 | 0 | 0 | 0 | 0 | 0 | 0 | 0 | ◎ | ○ | ○ | ○ | ○ | ● | | | | | | | | | 27 |
| 7 | 0110 | 0 | 0 | 0 | 0 | 0 | 0 | 1 | 0 | 0 | 0 | 0 | 0 | 0 | 0 | ◎ | ○ | ○ | ○ | ○ | ○ | ● | | | | | | | | 40 |
| 8 | 0111 | 0 | 0 | 0 | 0 | 0 | 0 | 0 | 1 | 0 | 0 | 0 | 0 | 0 | 0 | ◎ | ○ | ○ | ○ | ○ | ○ | ○ | ● | | | | | | | 56 |
| 9 | 1000 | 0 | 0 | 0 | 0 | 0 | 0 | 0 | 0 | 1 | 0 | 0 | 0 | 0 | 0 | ◎ | ○ | ○ | ○ | ○ | ○ | ○ | ○ | ● | | | | | | 75 |
| 10 | 1001 | 0 | 0 | 0 | 0 | 0 | 0 | 0 | 0 | 0 | 1 | 0 | 0 | 0 | 0 | ◎ | ○ | ○ | ○ | ○ | ○ | ○ | ○ | ○ | ● | | | | | 97 |
| 11 | 1010 | 0 | 0 | 0 | 0 | 0 | 0 | 0 | 0 | 0 | 0 | 1 | 0 | 0 | 0 | ◎ | ○ | ○ | ○ | ○ | ○ | ○ | ○ | ○ | ○ | ● | | | | 122 |
| 12 | 1011 | 0 | 0 | 0 | 0 | 0 | 0 | 0 | 0 | 0 | 0 | 0 | 1 | 0 | 0 | ◎ | ○ | ○ | ○ | ○ | ○ | ○ | ○ | ○ | ○ | ○ | ● | | | 150 |
| 13 | 1100 | 0 | 0 | 0 | 0 | 0 | 0 | 0 | 0 | 0 | 0 | 0 | 0 | 1 | 0 | ◎ | ○ | ○ | ○ | ○ | ○ | ○ | ○ | ○ | ○ | ○ | ○ | ● | | 182 |
| 14 | 1101 | 0 | 0 | 0 | 0 | 0 | 0 | 0 | 0 | 0 | 0 | 0 | 0 | 0 | 1 | ◎ | ○ | ○ | ○ | ○ | ○ | ○ | ○ | ○ | ○ | ○ | ○ | ○ | ● | 217 |
| 15 | 1110 | 0 | 0 | 0 | 0 | 0 | 0 | 0 | 0 | 0 | 0 | 0 | 0 | 0 | 0 | ◎ | ○ | ○ | ○ | ○ | ○ | ○ | ○ | ○ | ○ | ○ | ○ | ○ | ○ | 255 |

◎ : WRITING ADDRESS DISCHARGE + SUSTAIN DISCHARGE
○ : SUSTAIN DISCHARGE
● : ERASING ADDRESS DISCHARGE

FIG. 17A

FIG. 17B

FIG. 17C

FIG. 26A

FIG. 26B

FIG. 26C

DRIVING METHOD OF PLASMA DISPLAY PANEL

BACKGROUND OF THE INVENTION

1. Field of the Invention

The present invention relates to a driving method of a plasma display panel to which various driving pulses for light emission display are supplied.

2. Description of the Related Art

As a thin display device, an AC (alternate current discharge) type plasma display panel (PDP) is presently commercially available on the market. The PDP includes a plurality of column electrodes serving as address electrodes and n row electrodes pairs X and Y which are arranged to intersect the column electrodes, respectively. In the PDP, a row electrode for one line of the screen is formed of a pair of row electrodes X and Y. In the PDP, a discharge space, in which a discharge gas is encapsulated, is formed between the row electrodes X and Y and the column electrode, and a discharge cell that functions as a pixel is positioned at an intersection of each row electrode pair and the column electrode including the discharge space.

Since the PDP utilizes the discharge phenomenon to emit light, discharge cells only have two states, i.e., a light emission state corresponding to the highest luminance level and a non-light emission state corresponding to the lowest luminance level. Thus, in order to realize halftone luminance levels corresponding to an input video signal in the PDP, a gradation driving scheme using a subfield method is implemented. In the subfield method, one field display period is divided into N subfields such that each bit of N-bit pixel data corresponding to the input video signal corresponds to each subfield. Then, the number of light emissions (light emitting period) is allocated to each of the N subfields in correspondence with a weighting factor for each bit of the pixel data so that respective discharge cells are selectively lighted in accordance with each bit of the pixel data. That is, a prescribed amount of wall electric charges are formed in the discharge cells for light emission, and the wall electric charges formed on the discharge cells for non-light emission are erased. In this case, when implementing the driving method in the PDP device, a reset discharge is produced in the first field of each field display period so that the prescribed amount of wall electric charges are formed on the entire discharge cells. That is, the reset discharge causes light emissions on the entire screen that does not contribute to the display images. Therefore, the light emissions accompanied by the reset discharge that does not contribute to the display images may deteriorate the contrast of the displayed image, and in particular the dark contrast when displaying images of overall dark scenes.

In order to solve these problems, there is disclosed a driving method in which discharge cells for displaying a luminance level "0" are detected in advance and a reset discharge is not produced in the detected discharge cells (see FIG. 11 of Japanese Patent Kokai No. 2001-312244 (Patent Document 1)).

According to the driving method, as shown in FIG. 1, a selective initialization process $SR_C$ for the first subfield SF1 of one field is configured to supply an initialization data pulses RDP to column electrodes D in each display line. In this case, an initialization data pulses RDP of a low voltage ("0" volt) is supplied to the discharge cells for displaying a luminance level "0" and an initialization data pulses RDP of a high voltage is supplied to the discharge cells for display a luminance level other than "0." Simultaneously with the supply of the initialization data pulses RDP, a negative polarity scan pulse $SP_W$ is supplied to row electrodes Y. In this event, a reset discharge (a writing discharge) is produced only in those discharge cells at intersections of display lines supplied with the scan pulse $SP_W$ and the column electrodes supplied with the initialization data pulses of the high voltage, and wall electric charges are formed in the discharge cells. Meanwhile, the reset discharge is not produced in those discharge cells supplied with the initialization data pulses of the low voltage and the scan pulse $SP_W$. That is, the reset discharge is not produced in the discharge cells for displaying the luminance level "0." Therefore, the wall electric charges are not formed in these discharge cells.

In this way, the reset discharge for forming the wall electric charges is not produced in the discharge cells for displaying the luminance level "0" because they originally need not be lighted, thereby improving the dark contrast.

However, in the driving method shown in FIG. 1, in the last subfield SF14 of the one field display period, a negative polarity erase pulse EP is supplied to the entire row electrodes X, and an erasing discharge is produced in those discharge cells having the wall electric charges remaining thereon, thereby performing an erasing process E for removing the wall electric charges remaining on the entire discharge cells.

In this event, accompanied by the supply of the negative erasing pulse EP, positive polarity charges remain in the row electrodes X and Y. Moreover, accompanied by the supply of the initialization data pulses $DP_n$ of a positive polarity in a pixel data writing process $W_C$ for the last subfield SF14, negative polarity charges remain in the column electrodes D. Therefore, the column electrodes D and the row electrodes X and Y are respectively charged to the negative and positive polarity in a period ranging from the erasing process E to the selective initialization process $SR_C$ for the first subfield SF1 of a subsequent field. Accordingly, as shown in FIG. 1, the reset discharge (the writing discharge) cannot be produced securely even when the scan pulse $SP_W$ of a negative polarity and the initialization data pulses of a positive polarity are respectively supplied to the row electrodes Y and the column electrodes in the selective initialization process $SR_C$.

SUMMARY OF THE INVENTION

The invention has been made in view of those problems mentioned above, and its object is to provide a driving method of a plasma display panel capable of improving a dark contrast while preventing a spurious discharge.

A driving method of a plasma display panel in accordance with an aspect of the invention perform a gradation display in accordance with a video signal. The plasma display panel has discharge cells, functioning as pixels, at intersections of a plurality of row electrode pairs corresponding to display lines and a plurality of column electrodes arranged to intersect the row electrode pairs. The method includes the steps of performing an address writing process for producing a discharge between one of the row electrode pairs and the column electrodes in the remaining discharge cells excluding those discharge cells serving to display a luminance level "0", only in the first one of a plurality of subfields constituting a unit display period of the video signal so as to set the discharge cells to a light emitting cell state; performing, in each of the subfields, an address erasing process for selectively producing a discharge in the discharge cells in their light emitting cell states in accordance with pixel data corresponding to the video signal so as to change the states of the discharge cells to a non-light emitting cell state, and a sustain process for allowing only those discharge cells in their light emitting cell states to emit light by a number of times corresponding to the number of light emissions allocated in correspondence with a weighting factor for each of the subfields; producing a discharge only in the discharge cells in their light emitting cell states, only in the address erasing process for one selected from the subfields, so as to change the states of the discharge cells to the non-light emitting cell state; and supplying a voltage for charging the column electrodes to a negative polarity between the one of the row electrode pairs and the column electrodes, in either of the address writing process and the address erasing process, thereby producing the discharge between the one of the row electrode pairs and the column electrodes.

According the aspect of the invention, a discharge is produced in discharge cells only in an address erasing process for one subfield selected from a plurality of subfields constituting a unit display period, so that the states of the discharge cells are changed to a non-light emitting state. An address writing process for producing a discharge in the discharge cells so as to set the discharge cells to a light emitting state is performed before the address erasing process in the first one of the subfields. In this case, in either of the address writing process and the address erasing process, the discharge is produced between one of the row electrode pairs and the column electrodes by supplying a voltage for charging the column electrodes to a negative polarity between the one of the row electrode pairs and the column electrodes. Therefore, in the driving method of a plasma display panel, when expressing a black luminance level, various discharging processes can be securely performed without producing any discharges that accompany light emissions. Accordingly, it is possible to display with improved dark contrast without deteriorating the display quality.

BRIEF DESCRIPTION OF THE DRAWINGS

FIG. 9 is a diagram showing a data conversion table in a second data conversion circuit 34 shown in FIG. 3 and light emission driving patterns in one field display period.

FIGS. 17A to 17C are schematic diagrams showing the polarity changes in the electric charges formed on the column electrodes D and the row electrodes X and Y in each discharge cell in a case where the discharge cells are in the charge formation state as shown in FIG. 16A at a period immediately before the first subfield SF1.

FIGS. 26A to 26C are schematic diagrams showing the polarity changes in the electric charges formed on the column electrodes D and the row electrodes X and Y in each discharge cell in a case where the discharge cells are in the charge formation state as shown in FIG. 25A at a period immediately before the first subfield SF1, which is driven in accordance with those light emission driving format, driving pulses, and timings as shown in FIGS. 23 and 24.

DETAILED DESCRIPTION OF THE INVENTION

Hereinafter, embodiments of the invention will be described with reference to the accompanying drawings.

Figure 1:
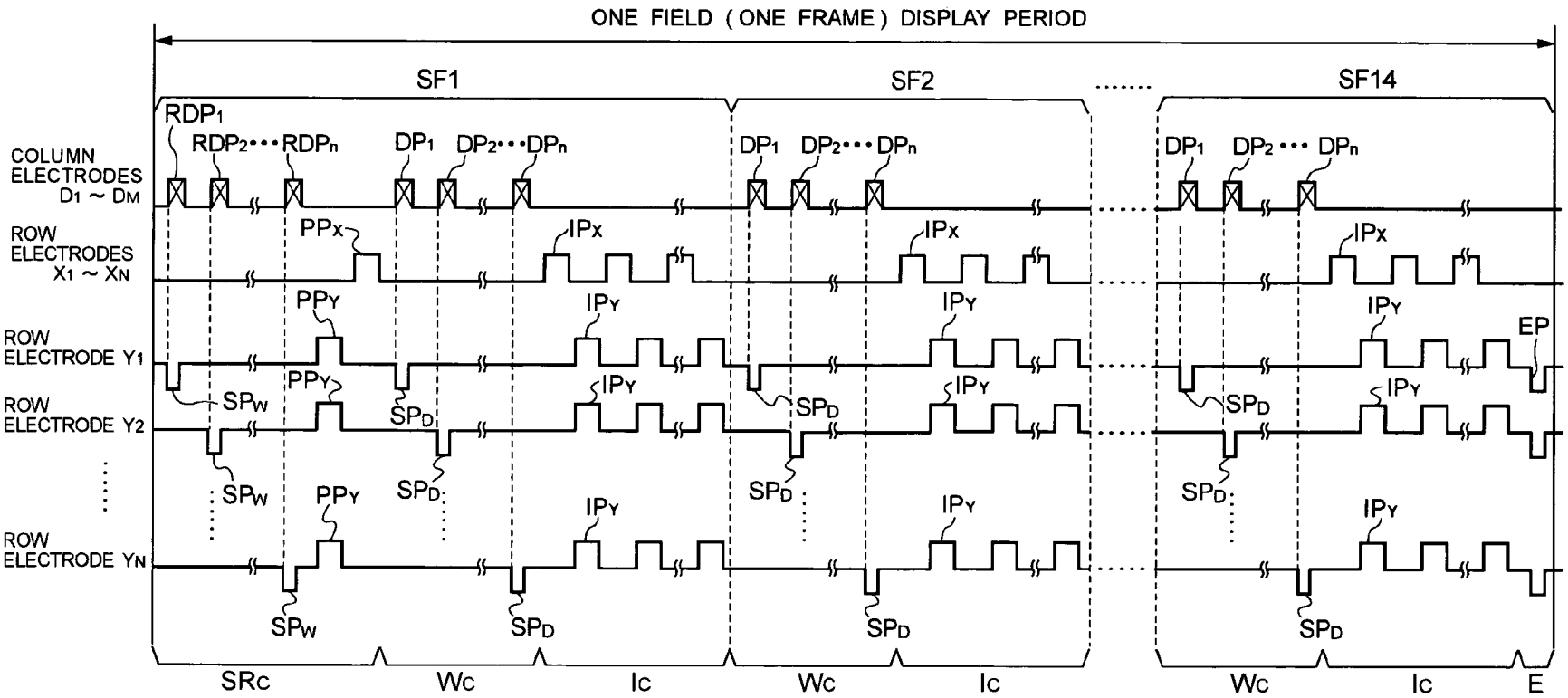
FIG. 1 is a diagram showing various driving pulses supplied to a plasma display panel in accordance with the known driving method.
Figure 2:
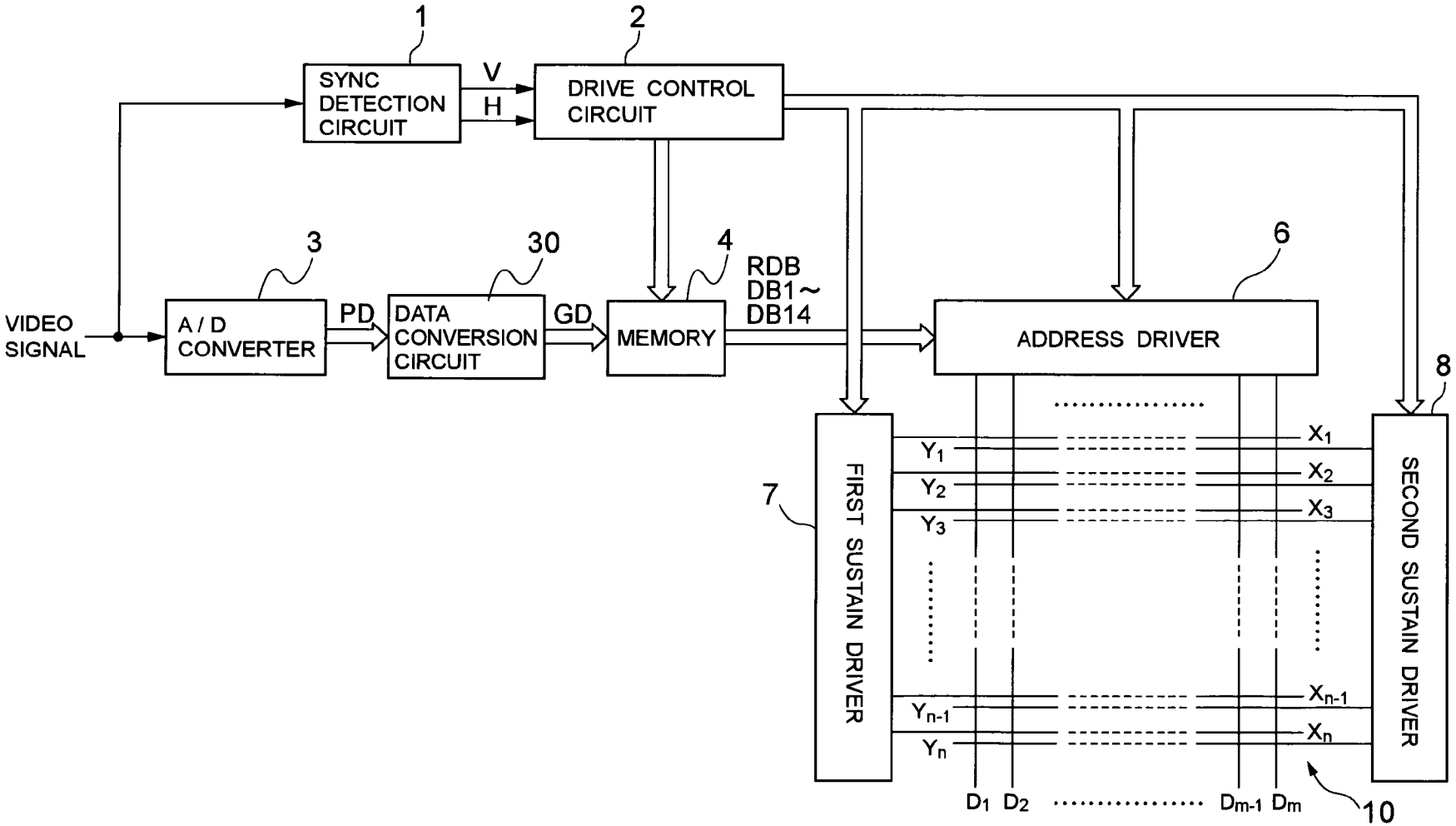
FIG. 2 is a schematic block diagram showing the configuration of a plasma display device that drives a plasma display panel in accordance with a driving method according to an embodiment of the invention.

FIG. 2 is a schematic block diagram showing the configuration of a plasma display device that drives a plasma display panel in accordance with a driving method according to an embodiment of the invention.

As shown in FIG. 2, the plasma display device comprises a PDP 10 as a plasma display panel, and a driving unit which is composed of various functional modules as described below.

The PDP 10 includes m column electrodes $D_1$ to $D_m$ as address electrodes, and n row electrodes $X_1$ to $X_n$ and n row electrodes $Y_1$ to $Y_n$ which are arranged to intersect these column electrodes, respectively. In the PDP 10, a row electrode for one line of the screen is formed of a pair of row electrodes X and Y. A discharge space, in which a discharge gas is encapsulated, is formed between the row electrodes X and Y and the column electrode D, and a discharge cell that functions as a pixel is positioned at an intersection of each row electrode pair and a column electrode including the discharge space.

The driving unit comprises a sync detection circuit 1, a drive control circuit 2, an A/D converter 3, a data conversion circuit 30, a memory 4, an address driver 6, a first sustain driver 7, and a second sustain driver 8.

A sync detection circuit 1 generates a vertical sync detection signal V when it detects a vertical sync signal from an input video signal, and a horizontal sync detection signal H when it detects a horizontal sync signal, and then supplies these sync detection signals to the drive control circuit 2. The A/D converter 3 samples and converts the input video signal to, for example, 8-bit pixel data PD on a pixel-by-pixel basis, and supplies the pixel data PD to the data conversion circuit 30.

The data conversion circuit 30 converts the 8-bit pixel data PD to 14-bit pixel drive data GD which is supplied to the memory 4.

Figure 3:
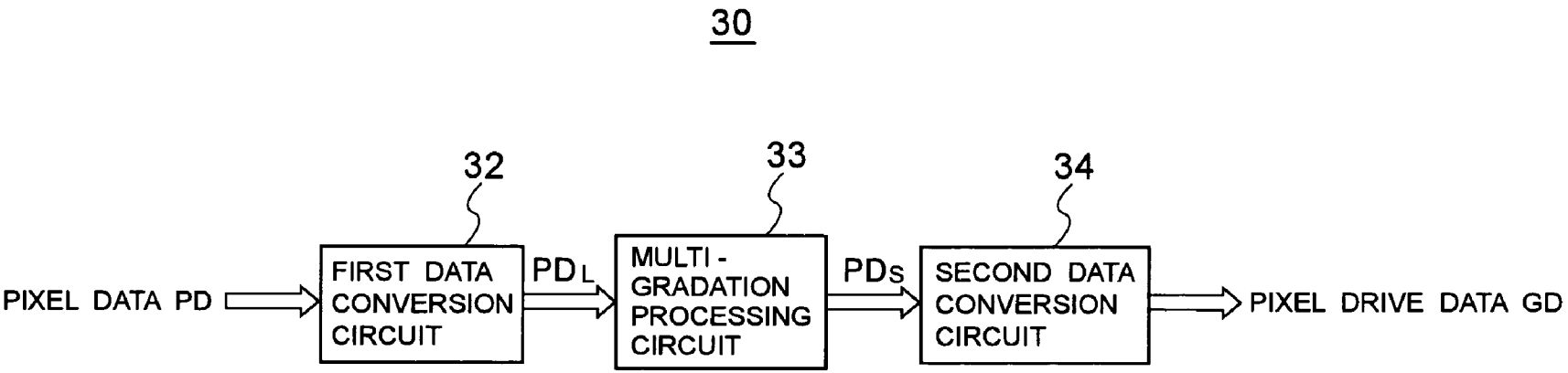
FIG. 3 is a block diagram showing the internal configuration of a data conversion circuit 30 shown in FIG. 2.

FIG. 3 is a block diagram showing the internal configuration of the data conversion circuit 30.

Figure 4:
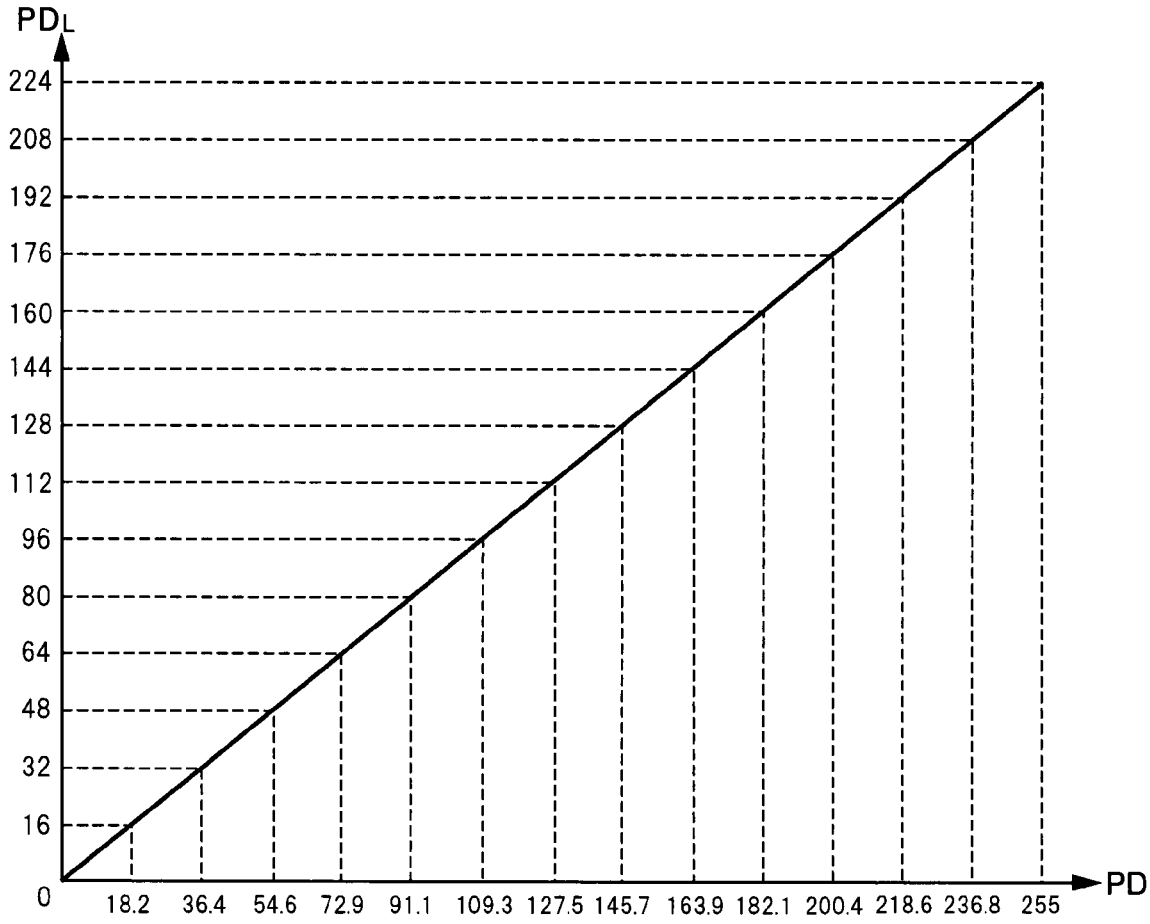
FIG. 4 is a graph showing a data conversion characteristic provided by a first data conversion circuit 32 shown in FIG. 3.

In FIG. 3, a first data conversion circuit 32 converts the 8-bit pixel data PD which is capable of expressing luminance levels in a range of "0" to "255" to 8-bit luminance limited pixel data $PD_L$ in a luminance range of levels from "0" to "224" in accordance with a conversion characteristic as shown in FIG. 4, and supplies the luminance limited pixel data $PD_L$ to a multi-gradation processing circuit 33.

The multi-gradation processing circuit 33 performs multi-gradation processing such as error diffusion processing, dither processing and so on, which provides a bit compression in accordance with a luminance distribution, to the 8-bit luminance limited pixel data $PD_L$ to generate 4-bit multi-gradation processed pixel $PD_S$.

Figure 5:
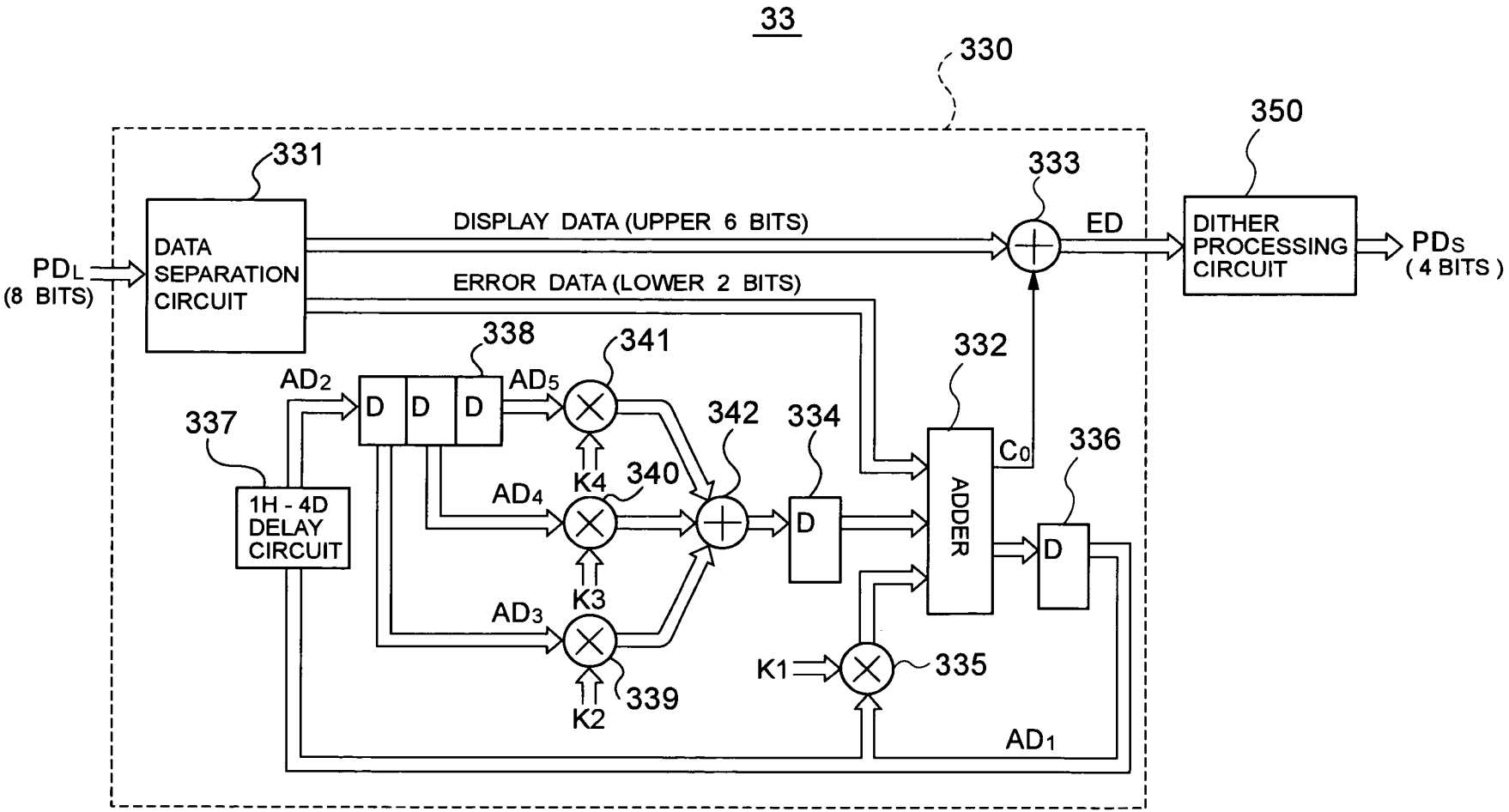
FIG. 5 is a block diagram showing the internal configuration of a multi-gradation processing circuit 33 shown in FIG. 3.

FIG. 5 is a block diagram showing the internal configuration of the multi-gradation processing circuit 33.

As shown in FIG. 5, the multi-gradation processing circuit 33 comprises an error diffusion processing circuit 330 and a dither processing circuit 350.

First, a data separation circuit 331 in the error diffusion processing circuit 330 separates the 8-bit luminance limited pixel data $PD_L$ supplied from the first data conversion circuit 32 into lower two bits as the error data and upper six bits as the display data. An adder 332 adds the error data, a delay output from a delay circuit 334, and a multiplication output of a coefficient multiplier 335 to produce an addition value which is supplied to a delay circuit 336. The delay circuit 336 delays the addition value supplied from the adder 332 by a delay time D having the same time as a clock period of the pixel data PD to produce a delayed addition signal $AD_1$ which is supplied to the coefficient multiplier 335 and to a delay circuit 337, respectively. The coefficient multiplier 335 multiplies the delayed addition signal $AD_1$ by a predetermined coefficient value $K_1$ (for example, "7/16"), and supplies the multiplication result to the adder 332. The delay circuit 337 further delays the delayed addition signal $AD_1$ by a time equal to [(one horizontal scan period)−(the delay time D)×(4)] to produce a delayed addition signal $AD_2$ which is supplied to a delay circuit 338. The delay circuit 338 further delays the delayed addition signal $AD_2$ by the delay time D to produce a delayed addition signal $AD_3$ which is supplied to a coefficient multiplier 339. The delay circuit 338 further delays the delayed addition signal $AD_2$ by a time equal to [(the delay time D)×(2)] to produce a delayed addition signal $AD_4$ which is supplied to a coefficient multiplier 340. The delay circuit 338 further delays the delayed addition signal $AD_2$ by a time equal to [(the delay time D)×(3)] to produce a delayed addition signal $AD_5$ which is supplied to a coefficient multiplier 341. The coefficient multiplier 339 multiplies the delayed addition signal $AD_3$ by a predetermined coefficient value $K_2$ (for example, "3/16"), and supplies the multiplication result to an adder 342. The coefficient multiplier 340 multiplies the delayed addition signal $AD_4$ by a predetermined coefficient value $K_3$ (for example, "5/16"), and supplies the multiplication result to the adder 342. The coefficient multiplier 341 multiplies the delayed addition signal $AD_5$ by a predetermined coefficient value $K_4$ (for example, "1/16"), and supplies the multiplication result to the adder 342. The adder 342 adds the multiplication results supplied from the respective coefficient multipliers 339, 340, and 341 to produce an addition signal which is supplied to the delay circuit 334. The delay circuit 334 delays the addition signal by the delay time D to produce a delayed signal which is supplied to the adder 332. The adder 332 adds the error data supplied from the data separation circuit 331, the delay output from the delay circuit 334, and the multiplication output from the coefficient multiplier 335, and generates a carry-out signal $C_O$ which is at logic level "0" when no carry is generated as a result of the addition, and at logic level "1" when a carry is generated. The carry-out signal $C_O$ is supplied to an adder 333. The adder 333 adds the carry-out signal $C_O$ to the display data supplied from the data separation circuit 331 to output the 6-bit error diffusion processed pixel data ED.

The operation of the error diffusion processing circuit 330 configured as described above will be described below.

Figure 6:
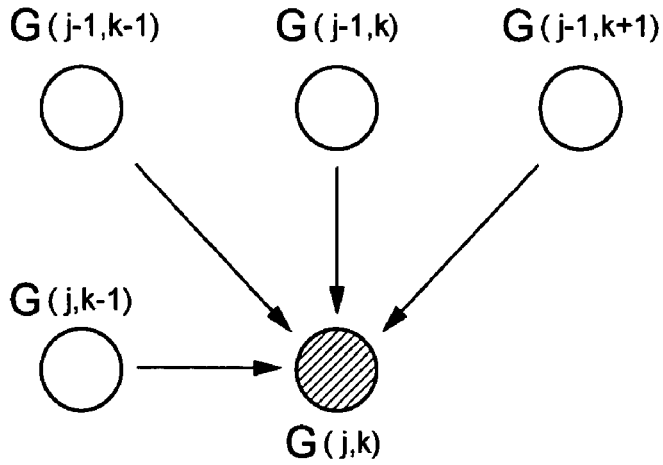
FIG. 6 is a diagram for explaining the operation of an error diffusion processing circuit 330 shown in FIG. 5.

For producing error diffusion processed pixel data ED corresponding to a pixel G(j, k) on the PDP 10, for example, as shown in FIG. 6, respective error data corresponding to a pixel G(j, k−1) on the left side of the pixel G(j, k), a pixel G(j−1, k−1) off to the upper left of the pixel G(j, k), a pixel G(j−1, k) above the pixel G(j, k), and a pixel G(j−1, k+1) off to the upper right of the pixel G(j, k), i.e.:

error data corresponding to the pixel G(j, k−1): delayed addition signal $AD_1$;

error data corresponding to the pixel G(j−1, k+1); delayed addition data $AD_3$;

error data corresponding to the pixel G(j−1, k): delayed addition data $AD_4$; and error data corresponding to the pixel G(j−1, k−1): delayed addition data $AD_5$, are weighted with the predetermined coefficient values $K_1$ to $K_4$, as mentioned above. Then, the weighted error data are added. Next, the lower two bits of the luminance limited pixel data $PD_L$, i.e., the error data corresponding to the pixel G(j, k) is added to the addition result. Then, a 1-bit carry-out signal $C_O$ resulting from the addition is added to the upper six bits of the luminance limited pixel data $PD_L$, i.e., the display data corresponding to the pixel G(j, k) to produce the error diffusion processed pixel data ED which is output from the error diffusion processing circuit.

With the configuration as described, the error diffusion processing circuit 330 regards the upper six bits of the luminance limited pixel data $PD_L$ as the display data, and the remaining lower two bits as the error data, and reflects the weighted addition of the error data at the respective peripheral pixels {G(j, k−1), G(j−1, k+1), G(j−1, k), G(j−1, k−1)} to the display data to produce the error diffusion processed pixel data ED. With this operation, the luminance for the lower two bits of the original pixel {G(j, k)} is virtually expressed by the peripheral pixels, so that gradation expressions of luminance equivalent to that provided by the 8-bit pixel data PD can be accomplished with the display data having a number of bits less than eight bits, i.e., six bits. However, if the coefficient values for the error diffusion were constantly added to respective pixels, noise due to an error diffusion pattern could be visually recognized to cause a deterioration in the image quality. To eliminate this inconvenience, the coefficients $K_1$ to $K_4$ for the error diffusion, which should be assigned to four pixels, may be changed from field to field (or from frame to frame) in a manner similar to dither coefficients, later described.

The dither processing circuit 350 shown in FIG. 5 performs a dither processing on the error diffusion processed pixel data ED supplied from the error diffusion processing circuit 330 to generate multi-level gradation processed pixel data $PD_S$ which has the number of bits reduced to 4 bits while maintaining the number of levels of luminance gradation which could be provided by 6-bit data. The dither processing used herein refers to a expression of an intermediate display level with a plurality of adjacent pixels. For example, for achieving a gradation display comparable to that available by eight bits by using only upper six bits of 8-bit pixel data, four pixels vertically and horizontally adjacent to each other are grouped into one set, and four dither coefficients a to d having coefficient values different from each other are assigned to respective pixel data corresponding to the respective pixels in the set, and the resulting pixel data are added. According to such dither processing, a combination of four different intermediate display levels can be produced with four pixels. Thus, for example, even if pixel data has six bits, an available number of levels of luminance gradation are four times as much. In other words, a halftone display comparable to that provided by eight bits can be achieved with six bits.

However, if a dither pattern formed of the dither coefficients a to d were constantly added to each pixel, noise due to the dither pattern could be visually recognized, thereby deteriorating the image quality.

To eliminate this inconvenience, the dither processing circuit 350 changes the dither coefficients a to d assigned to four pixels from field to field (or frame to frame).

Figure 7:
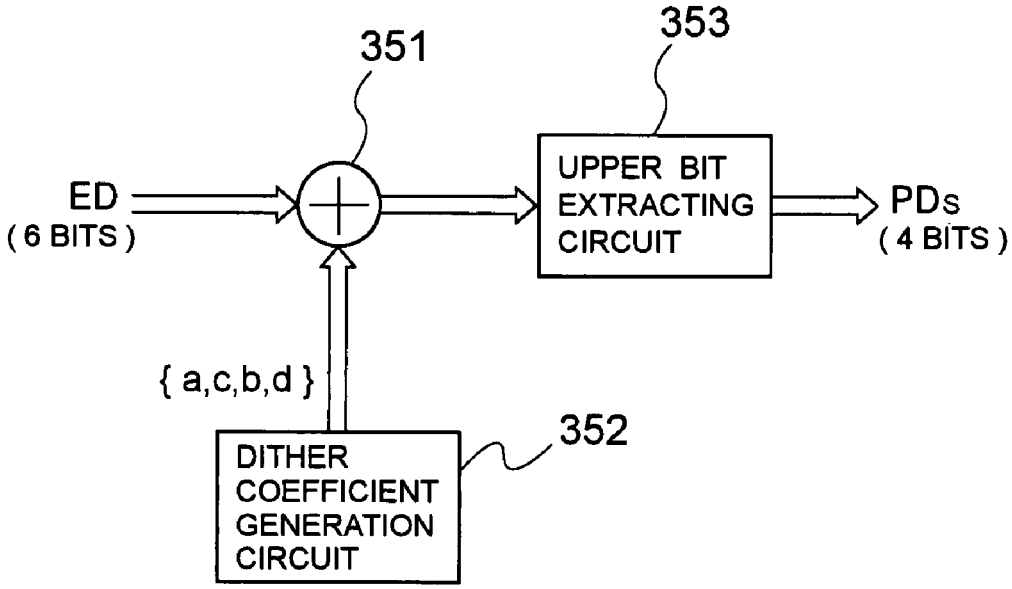
FIG. 7 is a block diagram showing the internal configuration of a dither processing circuit 350 shown in FIG. 5.

FIG. 7 is a block diagram showing the internal configuration of the dither processing circuit 350.

In FIG. 7, a dither coefficient generator circuit 352 generates four dither coefficients a, b, c, and d for four mutually adjacent pixels, and supplies these dither coefficients sequentially to an adder 351.

Figure 8:
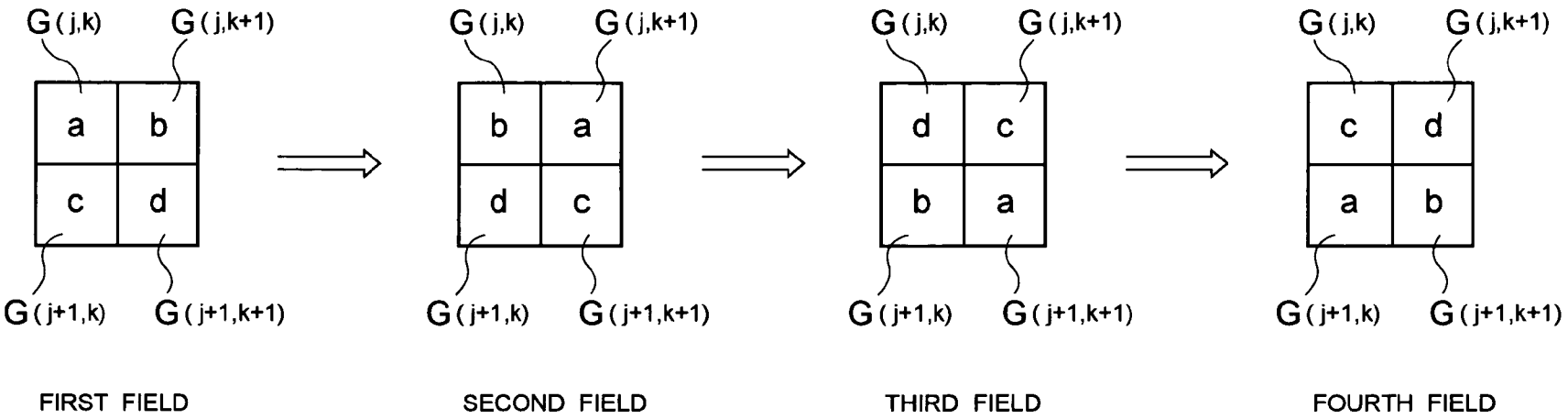
FIG. 8 is a diagram for explaining the operation of the dither processing circuit 350.

For example, as shown in FIG. 8, four dither coefficients a, b, c, and d are generated corresponding to four pixels: a pixel G(j, k) and a pixel G(j, k+1) corresponding to a j-th row, and a pixel G(j+1, k) and a pixel G(j+1, k+1) corresponding to a (j+1)th row, respectively. In this event, the dither coefficient generator circuit 352 changes the dither coefficients a to d assigned to these four pixels from field to field (or from frame to frame) as shown in FIG. 8.

Specifically, the dither coefficient generator circuit 352 repeatedly generates the dither coefficients a to d in a cyclic manner with the following assignment:

in the first field (or the first frame):
pixel G(j, k): dither coefficient a
pixel G(j, k+1): dither coefficient b
pixel G(j+1, k): dither coefficient c
pixel G(j+1, k+1): dither coefficient d
in the second field:
pixel G(j, k): dither coefficient b
pixel G(j, k+1): dither coefficient a
pixel G(j+1, k): dither coefficient d
pixel G(j+1, k+1): dither coefficient c
in the third field:
pixel G(j, k): dither coefficient d
pixel G(j, k+1): dither coefficient c
pixel G(j+1, k): dither coefficient b
pixel G(j+1, k+1): dither coefficient a
in the fourth field:
pixel G(j, k): dither coefficient c
pixel G(j, k+1): dither coefficient d
pixel G(j+1, k): dither coefficient a
pixel G(j+1, k+1): dither coefficient b Then, the dither coefficient generator circuit 352 repeatedly executes the operation in the first to fourth fields as described above. In other words, upon completion of the dither coefficient generating operation in the fourth field, the dither coefficient generator circuit 352 returns to the operation in the first field to repeat the foregoing operation.

The adder 351 adds the dither coefficients a to d to the error diffusion processed pixel data ED, respectively, supplied thereto from the error diffusion processing circuit 330, corresponding to the pixels G(j, k), G(j, k+1), G(j+1, k), G(j+1, k+1), to produce dither added pixel data which is supplied to an upper bit extracting circuit 353.

For example, in the first field shown in FIG. 8, the adder 351 sequentially supplies:

the error diffusion processed pixel data ED corresponding to the pixel G(j, k) plus the dither coefficient a;

the error diffusion processed pixel data ED corresponding to the pixel G(j, k+1) plus the dither coefficient b;

the error diffusion processed pixel data ED corresponding to the pixel G(j+1, k) plus the dither coefficient c; and the error diffusion processed pixel data ED corresponding to the pixel G(j+1, k+1) plus the dither coefficient d, to the upper bit extracting circuit 353 as the dither added pixel data.

The upper bit extracting circuit 353 extracts upper four bits of the dither added pixel data, and supplies the extracted bits to the second data conversion circuit 34 shown in FIG. 3 as the multi-level gradation processed pixel data $PD_S$.

The second data conversion circuit 34 converts the multi-level gradation processed pixel data $PD_S$ to converted pixel drive data GD consisting of first to fourteenth bits in accordance with a conversion table shown in FIG. 9 and supplies the converted pixel drive data GD to the memory 4.

The pixel drive data GD are sequentially written into the memory 4 in response to a write signal supplied from the driving control circuit 2. When the pixel drive data for one screen, i.e., (n×m) pixel drive data $GD_{(1,1)}$ to $GD_{(n,m)}$ corresponding to respective pixels from the first row, first column to the n-th row, m-th column have been written into the memory 4, the memory 4 performs a reading operation as follows.

First, the memory 4 regards the first bits of the respective pixel drive data $GD_{(1,1)}$ to $GD_{(n,m)}$ as initialization data bits $RDB_{(1,1)}$ to $RDB_{(n,m)}$, reads them for each display line in a subfield SF1 to be described later, and supplies them to the address driver 6.

Next, the memory 4 regards the second bits of the respective pixel drive data $GD_{(1,1)}$ to $GD_{(n,m)}$ as initialization data bit $DB2_{(1,1)}$ to $DB2_{(n,m)}$, reads them for each display line in a subfield SF2 to be described later, and supplies them to the address driver 6. Next, the memory 4 regards the third bits of the respective pixel drive data $GD_{(1,1)}$ to $GD_{(n,m)}$ as initialization data bits $DB3_{(1,1)}$ to $DB3_{(n,m)}$, reads them for each display line in a subfield SF3 to be described later, and supplies them to the address driver 6. Subsequently, in a similar manner, the memory 4 reads the 4-th bits to the 14-th bits of the respective pixel drive data $GD_{(1,1)}$ to $GD_{(n,m)}$ as pixel drive data bit DB3 to DB14, reads them for each display line in corresponding subfields SF, and supplies them to the address driver 6.

Figure 10:
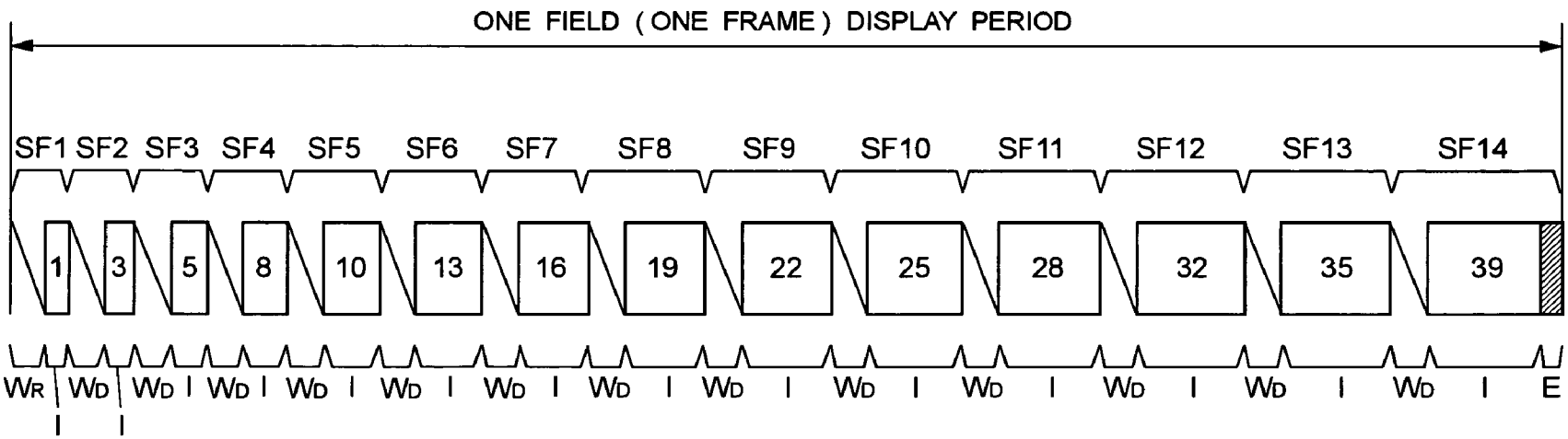
FIG. 10 is a diagram showing an example of a light emission driving format based on the driving method of the invention.

The drive control circuit 2 generates various timing signals for driving the PDP 10 to provide a gradation display in accordance with a light emission driving format as shown in FIG. 10, and supplies these timing signals to each of the address driver 6, first sustain driver 7 and second sustain driver 8.

In the light emission driving format shown in FIG. 10, one field (or one frame) display period (a unit display period) is divided into 14 subfields SF1 to SF14, and a negative polarity address writing process $W_R$ and a sustain process I are sequentially performed in the first subfield SF1. Further, a positive polarity address erasing process $W_D$ and the sustain process I are sequentially performed in each of the remaining subfields SF2 to SF14. In this case, an erasing process E is performed only in the last subfield SF14 after the sustain process I.

Figure 11:
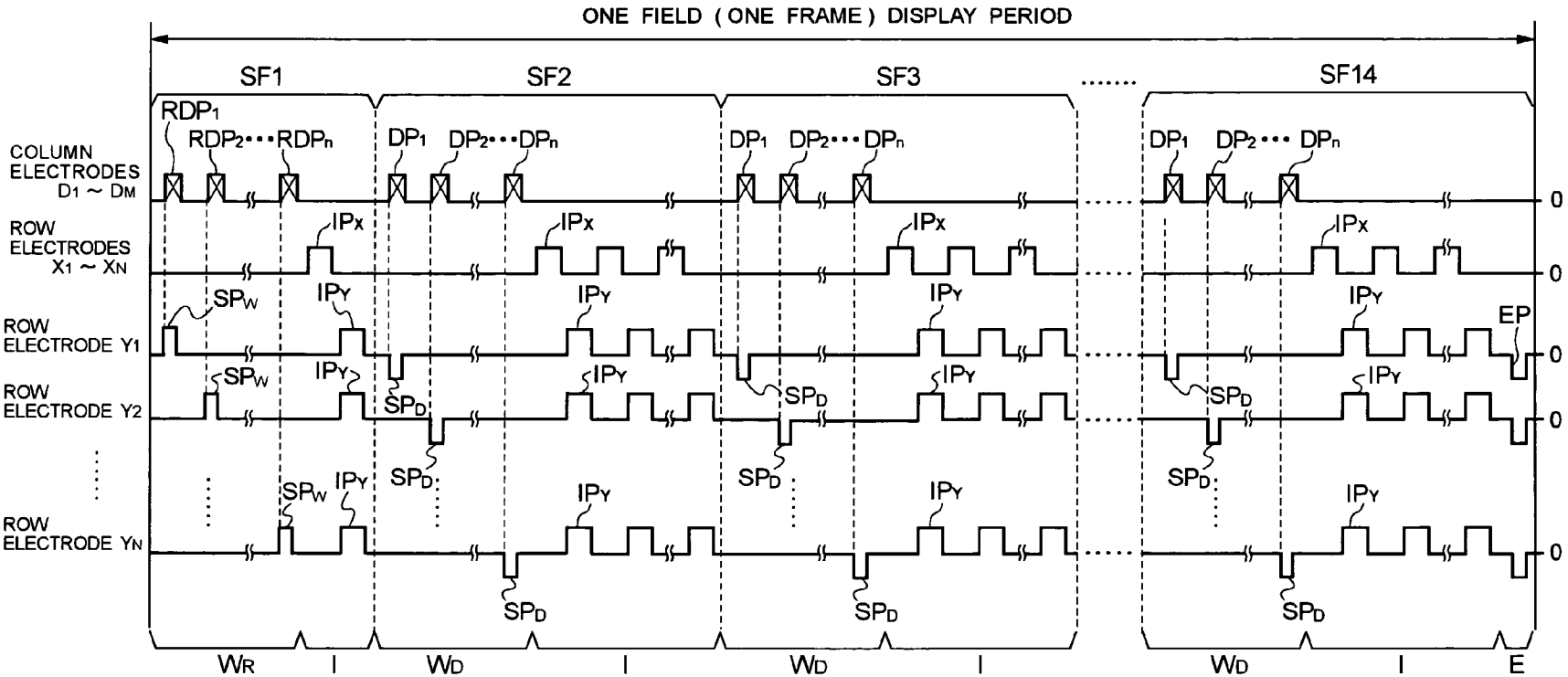
FIG. 11 is a diagram showing an example of various driving pulses supplied to a PDP 10 in accordance with the light emission driving format shown in FIG. 10, and timings at which the driving pulses are supplied.

FIG. 11 is a diagram showing various driving pulses supplied by each of the address driver 6, first sustain driver 7 and second sustain driver 8 to the column electrodes and row electrode pairs of the PDP 10 in accordance with the light emission driving format shown in FIG. 10, and timings at which the driving pulses are supplied.

In FIG. 11, in the negative polarity address writing process $W_R$ performed only for the first subfield SF1, the address driver 6 generates pixel data pulses having peak voltages corresponding to the pixel drive data bits $RDB_{(1,1)}$ to $RDB_{(n,m)}$ read out from the memory 4. For example, the address driver 6 generates pixel data pulses having peak voltages of a positive polarity in the case of the pixel drive data bits RDB with logic level "1" and generates pixel data pulses having peak voltages of the 0 voltage in the case of the pixel drive data bits RDB with logic level "0." Then, the address driver 6 groups the pixel data pulses for each display line into pixel data pulses groups $RDP_1$ to $RDP_n$ and sequentially supplies them to the column electrodes $D_1$ to $D_m$ of the PDP 10, as shown in FIG. 11. Further, in the negative polarity address writing process $W_R$, the second sustain driver 8 generates a positive polarity scan pulses $SP_W$ in synchronization with the supply of the pixel data pulses groups $RDP_1$ to $RDP_n$ and sequentially supplies the scanning pulse $SP_W$ to the row electrodes $Y_1$ to $Y_n$, as shown in FIG. 11. In this event, a writing address discharge is produced only in those discharge cells at intersections of the row electrodes Y supplied with the positive polarity scan pulses $SP_W$ and the columns electrodes D supplied with the pixel data pulses of the low voltage (0 volt). That is, the writing address discharge is produced between the row electrodes Y and the column electrodes D in the discharge cells, in a state that the row electrodes Y are charged to a positive polarity and the column electrodes D serving as the address electrodes are charged to a negative polarity. In this way, wall electric charges are formed in the discharge cells in which the writing address discharge is produced, and the discharge cells are set to a light emitting cell state where a sustain discharge can be produced in a sustain process I to be described later. Meanwhile, the writing address discharge as described above is not produced in those discharge cells supplied with the pixel data pulses having peak voltages of a positive polarity and the scan pulses $SP_W$. Therefore, the wall electric charges are not formed in the discharge cells, and the discharge cells are set to a non-light emitting cell state where the sustain discharge cannot be produced in the sustain process I described later.

Here, whether or not the writing address discharge is produced in the negative polarity address writing process $W_R$ depends on the logic level of the first bit of the pixel drive data GD shown in FIG. 9. As shown in FIG. 9, the first bit of the pixel drive data GD is at logic level "1" when the multi-gradation processed pixel data $PD_S$ is "0000", i.e., indicative of a luminance level "0", and the first bit thereof is at logic level "0" when the $PD_S$ indicates a luminance level higher than the luminance level "0". Then, the writing address discharge is produced only in a case where the first bit of the pixel drive data GD is at logic level "0".

In this way, in the negative polarity address writing process $W_R$, the pixel data pulses of the low voltage (0 volt) are supplied to the discharge cells corresponding to the pixel data for expressing a luminance level greater than the luminance level "0", whereby the writing address discharge is produced in the discharge cells so that the discharge cells are set to the light emitting cell state. Meanwhile, the pixel data pulses having peak voltages of a positive polarity are supplied to the discharge cells corresponding to the pixel data for expressing the luminance level "0", whereby the writing address discharge is not produced in the discharge cells so that the discharge cells are set to the non-light emitting cell state. That is, since it is basically unnecessary to set the discharge cells to the light emitting cell state when expressing the luminance level "0", the pixel data pulses having the same polarity as that of the scan pulse $SP_W$ are supplied to the discharge cells so that the writing address discharge is not produced in the discharge cells. In this way, it is possible to improve the dark contrast compared with the case where the address discharge for forming the wall electric charges is produced in the entire discharge cells even when expressing the luminance level "0".

Meanwhile, in FIG. 11, in the positive polarity address erasing process $W_D$ performed in each of the remaining subfields SF2 to SF14, the address driver 6 generates pixel data pulses having peak voltages corresponding to the pixel drive data bits $DB_{(1,1)}$ to $DB_{(n,m)}$ read out from the memory 4. For example, the address driver 6 generates pixel data pulses having peak voltages of a positive polarity in the case of the pixel drive data bits DB with logic level "1" and generates pixel data pulses having peak voltages of the 0 voltage in the case of the pixel drive data bits DB with logic level "0." Then, the address driver 6 groups the pixel data pulses for each display line into pixel data pulses groups $DP_1$ to $DP_n$ and sequentially supplies them to the column electrodes $D_1$ to $D_m$ of the PDP 10, as shown in FIG. 11. Further, in the negative polarity address writing process $W_R$, the second sustain driver 8 generates a negative polarity scan pulses $SP_D$ in synchronization with the supply of the pixel data pulses groups $DP_1$ to $DP_n$ and sequentially supplies the scanning pulse $SP_D$ to the row electrodes $Y_1$ to $Y_n$, as shown in FIG. 11. In this event, an erasing address discharge is produced only in those discharge cells at intersections of the row electrodes Y supplied with the negative polarity scan pulses $SP_D$ and the columns electrodes D supplied with the positive polarity pixel data pulses. That is, the erasing address discharge is produced between the row electrodes Y and the column electrodes D in the discharge cells, in a state that the row electrodes Y are charged to a negative polarity and the column electrodes D serving as the address electrodes are charged to a positive polarity. In this way, the wall electric charges remaining on the discharge cells are erased by the production of the erasing address discharge, and the discharge cells are set to the non-light emitting cell state where the sustain discharge cannot be produced in the sustain process I described later. Meanwhile, since the erasing address discharge as described above is not produced in those discharge cells supplied with the pixel data pulses of the low voltage and the scan pulses $SP_D$, the discharge cells maintain their cell states. That is, the discharge cells remain in the light emitting cell state in the case of the presence of the wall electric charges and remain in the non-light emitting cell state in the case of the absence of the wall electric charges.

Here, whether or not the erasing address discharge is produced in the positive polarity address erasing process $W_D$ depends on the respective logic level of the second to 14-th bits of the pixel drive data GD corresponding to the subfields SF2 to SF14, as shown in FIG. 9. That is, the erasing address discharge is produced in the positive polarity address erasing process $W_D$ for the subfields SF corresponding to the bit of the pixel drive data GD, only in a case where the corresponding bit of the pixel drive data GD is at logic level "1".

Next, in the sustain process I performed for each of the subfields SF1 to SF14, each of the first sustain driver 7 and the second sustain driver 8 repeatedly supplies the sustain pulses $IP_X$ and $IP_Y$ of a positive polarity to the row electrodes $X_1$ to $X_n$ and $Y_1$ to $Y_n$ in alternation, as shown in FIG. 11. In this event, the number of times the sustain pulses IP should be supplied in each sustain process I is determined on the basis of a weighting factor for the gradation luminance of each subfield. For example, as shown in FIG. 10, assuming that the number of light emissions is "1" in the first subfield SF1, the number of light emissions in the sustain process I for each subfield is as follow:

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

With the sustain process I, the sustain discharge is produced only in those discharge cells having the wall electric charges remaining thereon, i.e., only those in the light emitting cell state whenever the sustain pulses $IP_X$ and $IP_Y$ are supplied thereto. In this case, the light emissions accompanied by the sustain discharge in the discharge cells are repeated by the above-mentioned number of times (periods).

Next, in the erasure process E performed only for the last subfield SF14 of one field (or one frame) display period, the second sustain driver 8 supplies erasure pulses EP of a negative polarity to the row electrodes $Y_1$ to $Y_n$, as shown in FIG. 11. Therefore, an erasing discharge for erasing the wall electric charges is produced between the row electrodes Y and the column electrodes D in the discharge cells having the wall electric charges remaining thereon, in a state that the row electrodes Y are charged to a negative polarity and the column electrodes D are charged to a positive polarity. Accordingly, with the erasing process E, the entire discharge cells are set to the non-light emitting cell state where the wall electric charges are not present.

By repeating those operations as shown in FIGS. 9 to 11 in each field (frame), a luminance level corresponding to the total number of light emissions caused in the sustain process I for each of the subfields SF in each field display period can be expressed on the screen. According to the light emission driving format as shown in FIG. 10, a chance for setting the discharge cells to the light emitting cell state exist only in the negative polarity address writing process $W_R$ for the first subfield SF1 of the one field (or one frame) display period. Here, according to the bit pattern of the pixel drive data GD as shown in FIG. 9, the positive polarity address erasing discharge in which the wall electric charges are erased from the discharge cells is produced only in the positive polarity address erasing process $W_D$ for only one subfield of the one field display period, as indicated by the black circles in the figure. Therefore, the wall electric charges formed by the writing address discharge produced in the negative polarity address writing process $W_R$ for the first subfield SF1 remain until the positive polarity address erasing discharge is produced, so that each discharge cell remains in the light emitting cell state, as indicated by the double circles in the figure. Consequently, light emissions accompanied by the sustain discharge are continuously caused in each sustain process I for each of the subfields (indicated by white circles) intervening therebetween. When the gradation driving is performed as shown in FIGS. 10 and 11 using the pixel drive data GD which can take 15 bit patterns as shown in FIG. 9, 15 types of light emissions in which the number of performing the sustain discharge in the one field (or one frame) display period is different from each other are caused to provide 15 levels of intermediate display luminance as follows:

{0, 1, 4, 9, 17, 27, 40, 56, 75, 97, 122, 150, 182, 217, 255}

Meanwhile, the pixel data PD generated by the A/D converter 3 has 8 bits and hence can express halftones with 256 levels. As such, the multi-gradation processing circuit 33 shown in FIG. 3 performs a multi-gradation processing in order to virtually realize a halftone display with 256 levels even with the 15-level gradation driving.

In the driving method described above, since the reset discharge for producing a discharge in the entire discharge cells is not performed in order to equalize the wall electric charged in the entire discharge cells, the dark contrast when displaying dark images is improved.

In the driving method shown in FIG. 11, a discharge (the writing address discharge) is produced between the row electrodes Y of a positive polarity and the column electrodes D of a negative polarity in the negative polarity address writing process $W_R$ for the first subfield SF1. In this way, the discharge (the writing address discharge) can be securely produced in the negative polarity address writing process $W_R$ for the first subfield SF1, even in a case where the erasing discharge for charging the row electrodes Y to the negative polarity and the column electrodes D to the positive polarity is performed in the erasing process E for the first subfield SF14 at a period immediately before the first subfield SF1.

Hereinafter, the reason why the discharge (the writing address discharge) can be securely produced in the negative polarity address writing process $W_R$ will be described.

Figure 12A:
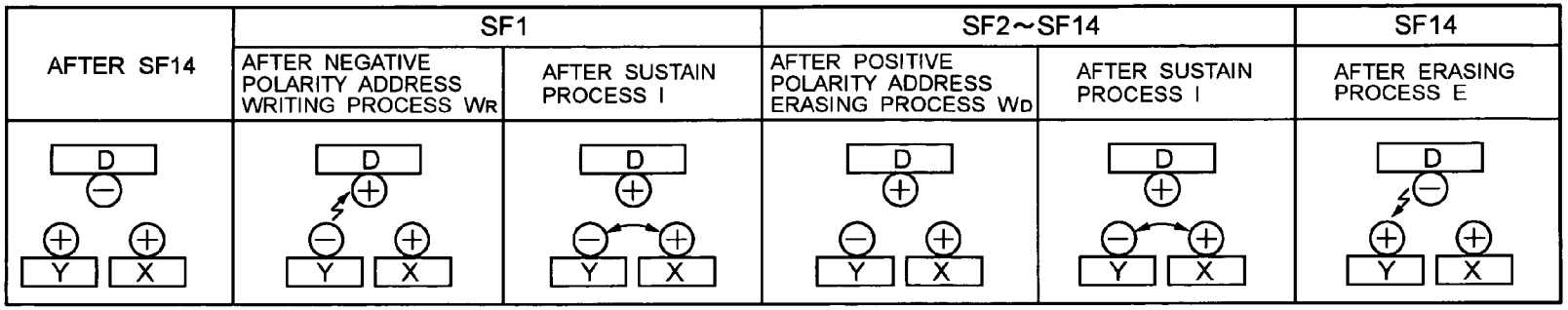
FIGS. 12A to 12C are schematic diagrams showing polarity changes in electric charges formed on column electrodes D and row electrodes X and Y in each discharge cell in a unit display period.
Figure 12B:
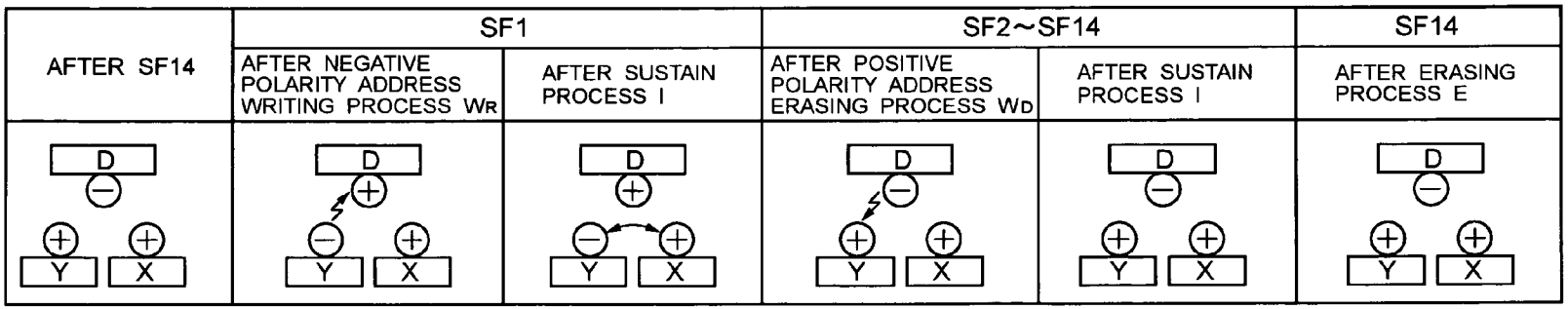
Figure 12C:
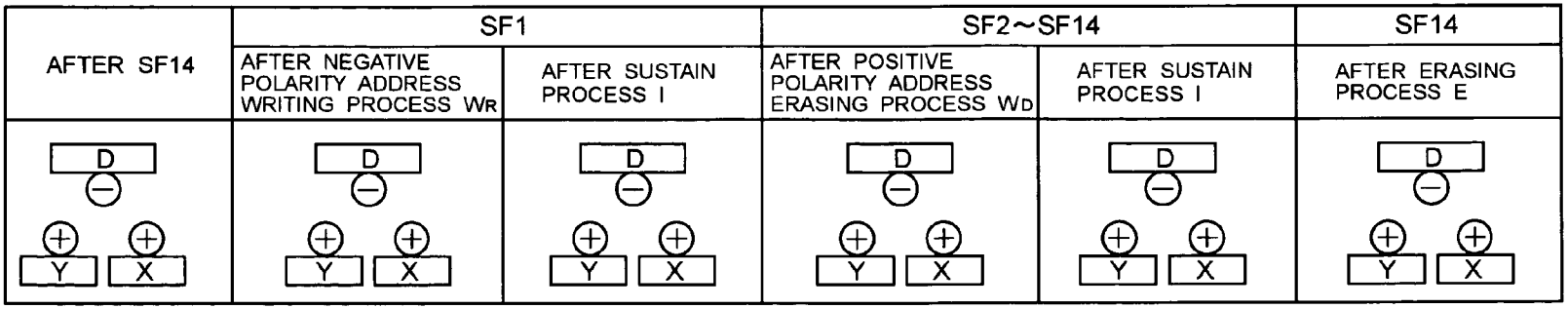

FIGS. 12A to 12C are schematic diagrams showing polarity changes in electric charges formed on the column electrodes D and the row electrodes X and Y in each discharge cell in the unit display period (subfields SF1 to SF14).

FIG. 12A shows the polarity changes in electric charges in the discharge cells in the case of the 15-level gradation driving scheme for expressing the highest luminance level as shown in FIG. 9.

In FIG. 12A, at a period immediately before the first subfield SF1, i.e., at a period after performing the erasing process E for the first subfield SF14, positive polarity charges are formed in the vicinity of the row electrodes X and Y, and negative polarity charges are formed in the vicinity of the column electrodes D. In this event, since the electric charges formed on the row electrodes X and Y have the same (positive) polarity, the discharge cells are in the non-light emitting cell state.

Next, in the negative polarity address writing process $W_R$ for the first subfield SF1, as shown in FIG. 11, an writing address discharge is produced between the row electrodes Y and the column electrodes D in the discharge cells, in a state that the column electrodes D in the discharge cells are charged to a negative polarity in accordance with the supply of the scan pulses $SP_W$ of a positive polarity voltage to the row electrodes Y and the pixel data pulses RDP of a low voltage ("0" volt) to the column electrodes D. In this way, in the discharge cells, positive electric charges are formed in the vicinity of the row electrodes X, negative electric charges are formed in the vicinity of the row electrodes Y, and positive electric charges are formed in the vicinity of the column electrodes D, respectively. In this event, since the electric charges formed on the row electrodes X and Y have a different polarity, the discharge cells are in the light emitting cell state.

Next, in the sustain process I for the first subfield SF1, the sustain discharge is produced between the row electrodes X and the row electrodes Y in the discharge cells whenever the sustain pulses IP of a positive polarity voltage are alternately supplied to the row electrodes X and Y in this order. In this event, the sustain pulses $IP_Y$ supplied to the electrodes Y is the last one of the sustain pulses $IP_X$ and $IP_Y$ supplied to the row electrodes X and Y in the sustain process I. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. In this event, since the electric charges formed on the row electrodes X and Y have a different polarity, the discharge cells are in the light emitting cell state.

In this case, as shown in FIG. 9, in the 15-level gradation driving scheme, the erasing address discharge (indicated by the dark circles) is not produced in the positive polarity address erasing process $W_D$ for any one subfield of the SF2 to SF14 and the discharge cells maintain their light emitting cell states for those periods.

Therefore, in the sustain process I for each of the subfields SF2 to SF14, the sustain discharge is produced between the row electrodes X and the row electrodes Y in the discharge cells whenever the sustain pulses IP of a positive polarity voltage are alternately supplied to the row electrodes X and Y in this order. In this event, the sustain pulses $IP_Y$ supplied to the electrodes Y is the last one of the sustain pulses $IP_X$ and $IP_Y$ supplied to the row electrodes X and Y in the sustain process I for each of the subfields SF2 to SF14. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. In this event, since the electric charges formed on the row electrodes X and Y have a different polarity, the discharge cells are in the light emitting cell state.

In the erasing process E for the last subfield SF14, the erasing discharge is produced between the row electrodes Y and the column electrodes D in the discharge cells in accordance with the supply of the erasing pulses EP of a negative polarity voltage to the row electrodes Y, whereby positive electric charges are formed in the vicinity of the row electrodes Y. Therefore, at a period after performing the erasing process E for the first subfield SF14, in the discharge cells, positive electric charges are formed in the vicinity of the row electrodes X and Y, and negative electric charges are formed in the vicinity of the column electrodes D. In this event, since the electric charges formed in the row electrodes X and Y have the same polarity, the discharge cells are in the non-light emitting cell state.

FIG. 12B shows the polarity changes in electric charges in the discharge cells in the case of the second to 14-th level gradation driving scheme as shown in FIG. 9.

In FIG. 12B, at a period immediately before the first subfield SF1, i.e., at a period after performing the erasing process E for the first subfield SF14, positive polarity charges are formed in the vicinity of the row electrodes X and Y, and negative polarity charges are formed in the vicinity of the column electrodes D. In this event, since the electric charges formed on the row electrodes X and Y have the same polarity (positive polarity), the discharge cells are in the non-light emitting cell state.

Next, in the negative polarity address writing process $W_R$ for the first subfield SF1, as shown in FIG. 11, a writing address discharge is produced between the row electrodes Y and the column electrodes D in the discharge cells, in a state that the column electrodes D in the discharge cells are charged to a negative polarity in accordance with the supply of the scan pulses $SP_W$ of a positive polarity voltage to the row electrodes Y and the pixel data pulses RDP of a low voltage ("0" volt) to the column electrodes D. In this way, in the discharge cells, positive electric charges are formed in the vicinity of the row electrodes X, negative electric charges are formed in the vicinity of the row electrodes Y, and positive electric charges are formed in the vicinity of the column electrodes D, respectively. In this event, since the electric charges formed on the row electrodes X and Y have a different polarity, the discharge cells are in the light emitting cell state.

Next, in the sustain process I for the first subfield SF1, the sustain discharge is produced between the row electrodes X and the row electrodes Y in the discharge cells whenever the sustain pulses IP of a positive polarity voltage are alternately supplied to the row electrodes Y and Y in this order. In this event, the sustain pulses $IP_Y$ supplied to the electrodes Y is the last one of the sustain pulses $IP_X$ and $IP_Y$ supplied to the row electrodes X and Y in the sustain process I. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. In this event, since the electric charges formed on the row electrodes X and Y have a different polarity, the discharge cells are in the light emitting cell state.

In this case, as shown in FIG. 9, in the second to 14-th level gradation driving scheme, the erasing address discharge (indicated by the dark circles) is produced in the positive polarity address erasing process $W_D$ for one subfield of the SF2 to SF14. That is, in the positive polarity address erasing process $W_D$ for the one subfield of the SF2 to SF14, as shown in FIG. 11, an erasing address discharge is produced between the row electrodes Y and the column electrodes D in the discharge cells, in a state that the column electrodes D in the discharge cells are charged to a positive polarity in accordance with the supply of the scan pulses $SP_D$ of a negative polarity voltage to the row electrodes Y and the pixel data pulses DP of a positive polarity voltage to the column electrodes D. In this way, in the discharge cells, positive electric charges are formed in the vicinity of the row electrodes X and Y, and negative electric charges are formed in the vicinity of the column electrodes D. In this event, since the electric charges formed on the row electrodes X and Y have the same polarity, the discharge cells are in the non-light emitting cell state.

Therefore, in the sustain process I for each of the subfields SF2 to SF14 at a period immediately before the production of the erasing address discharge, the sustain discharge is produced between the row electrodes X and the row electrodes Y in the discharge cells whenever the sustain pulses IP of a positive polarity voltage are alternately supplied to the row electrodes X and Y in this order. In this event, the sustain pulses $IP_Y$ supplied to the electrodes Y is the last one of the sustain pulses $IP_X$ and $IP_Y$ supplied to the row electrodes X and Y in the sustain process I for each subfield. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. In this event, since the electric charges formed on the row electrodes X and Y have a different polarity, the discharge cells are in the light emitting cell state.

Meanwhile, in the sustain process I for the subfield at which the erasing address discharge is produced and subsequent subfields, the sustain discharge is not produced even when the sustain pulses IP of a positive polarity voltage are alternately supplied to the row electrodes X and Y in this order. Therefore, at a period after performing the sustain process I for each subfield, in the discharge cells, positive electric charges are formed in the vicinity of the row electrodes X and Y, and negative electric charges are formed in the vicinity of the column electrodes D, respectively. In this event, since the electric charges formed in the row electrodes X and Y have the same polarity, the discharge cells are in the non-light emitting cell state.

In the erasing process E for the last subfield SF14, since the same positive electric charges are formed in the vicinity of the row electrodes X and Y, the erasing discharge is not produced even when the erasing pulses EP of a negative polarity voltage are supplied to the row electrodes Y. Therefore, at a period after performing the erasing process E, in the discharge cells, the same positive electric charges remain in the vicinity of the row electrodes X and Y, and negative electric charges remain in the vicinity of the column electrodes D.

FIG. 12C shows the polarity changes in electric charges in the discharge cells in the case of the first level gradation driving scheme for expressing the lowest luminance level (black luminance level) as shown in FIG. 9.

In FIG. 12C, at a period immediately before the first subfield SF1, i.e., at a period after performing the erasing process E for the first subfield SF14, positive polarity charges are formed in the vicinity of the row electrodes X and Y, and negative polarity charges are formed in the vicinity of the column electrodes D. In this event, since the electric charges formed on the row electrodes X and Y have the same (positive) polarity, the discharge cells are in the non-light emitting cell state. Here, in the first level gradation driving scheme for expressing the lowest luminance level (black luminance level), the discharge is not produced in any subfield of the SF1 to SF14, as shown in FIG. 9. Therefore, as shown in FIG. 12C, in a period from the first subfield SF1 to the first subfield SF14, the discharge cells maintain their cell states they originally had in a period immediately before the first subfield SF1 is maintained: that is, in the discharge cells, the same positive electric charges are formed in the vicinity of the row electrodes X and Y, and the negative electric charges are formed in the vicinity of the column electrodes D.

As described above, in the driving method shown in FIG. 11, in order to selectively set the discharge cells to the light emitting cell state in accordance with the pixel data only in the first subfield SF1, a discharge (a writing address discharge) for forming wall electric charges is produced by supplying the row electrodes Y with a voltage (the peak voltage of scan pulse $SP_W$) higher than the voltage (0 volt) supplied to the column electrodes D. Therefore, since, in order to produce the erasing discharge in the erasing process E for the last subfield SF14, a voltage (the peak voltage of the erasing pulse EP) lower than that supplied to the column electrodes D is supplied to the row electrodes Y only in those discharge cells having wall electric charges remaining thereon, it is possible to securely produce the writing address discharge even in the presence of the positive electric charges in the vicinity of the row electrodes Y.

Moreover, in the driving method, as shown in FIG. 9, since the discharge is not produced in the first level gradation driving scheme for expressing the lowest luminance level (black luminance level), it is possible to improve the dark contrast.

According to the embodiment shown in FIG. 11, in the negative polarity address writing process $W_R$ for the first subfield SF1, the writing address discharge is produced between the row electrodes Y and the column electrodes D by supplying the 0 voltage to the column electrodes D during the supply of the positive polarity scan pulse $SP_W$ to the row electrodes Y.

Figure 13:
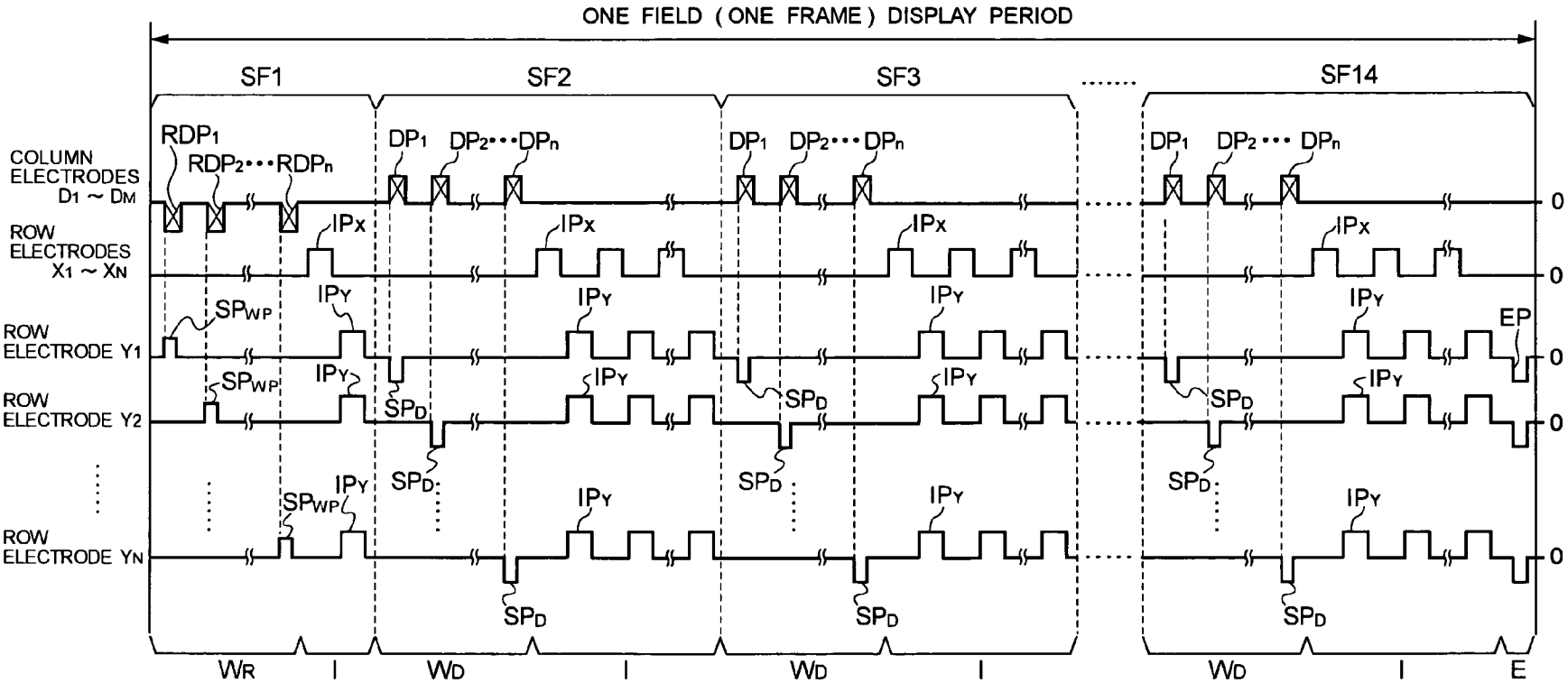
FIG. 13 is a diagram showing another example of various driving pulses supplied to the PDP 10 in accordance with the light emission driving format shown in FIG. 10, and timings at which the driving pulses are supplied.

However, when producing the writing address discharge in the negative polarity address writing process $W_R$, the voltage supplied to the column electrodes D need not always be the 0 voltage but may be a negative polarity voltage, as shown in FIG. 13. That is, the address driver 6 may generate pixel data pulses of a low voltage (0 volt) in the case of the pixel drive data bits RDB with logic level "1" and generate pixel data pulses of a negative polarity voltage in the case of the pixel drive data bits RDB with logic level "0." Then, the address driver 6 groups the pixel data pulses for each display line into pixel data pulses groups $RDP_1$ to $RDP_n$ and sequentially supplies them to the column electrodes $D_1$ to $D_m$ of the PDP 10, as shown in FIG. 13. In this event, the writing address discharge as described above is produced in those discharge cells at intersections of the row electrodes Y supplied with the positive polarity scan pulses $SP_{WP}$ and the columns electrodes D supplied with the pixel data pulses of the negative polarity voltage, as shown in FIG. 13. Meanwhile, the writing address discharge is not produced in those discharge cells supplied with the pixel data pulses of the low voltage (0 volt) and the positive polarity scan pulses $SP_{WP}$. In this case, as the peak voltage of the scan pulses $SP_{WP}$, a voltage at which the discharge may not be produced even in the case of the column electrodes D of the 0 voltage is used. That is, the peak voltage of the scan pulses $SP_{WP}$ shown in FIG. 13 is lower than the peak voltage of the scan pulses $SP_W$ shown in FIG. 11.

In the driving method shown in FIG. 11 or 13, although the erasing process E performed in the last subfield SF14 is configured to produce the erasing discharge only in those discharge cells having wall electric charges remaining thereon and remove the wall electric charges, the invention may be applied to a case where the erasing process E is not performed.

Figure 14:
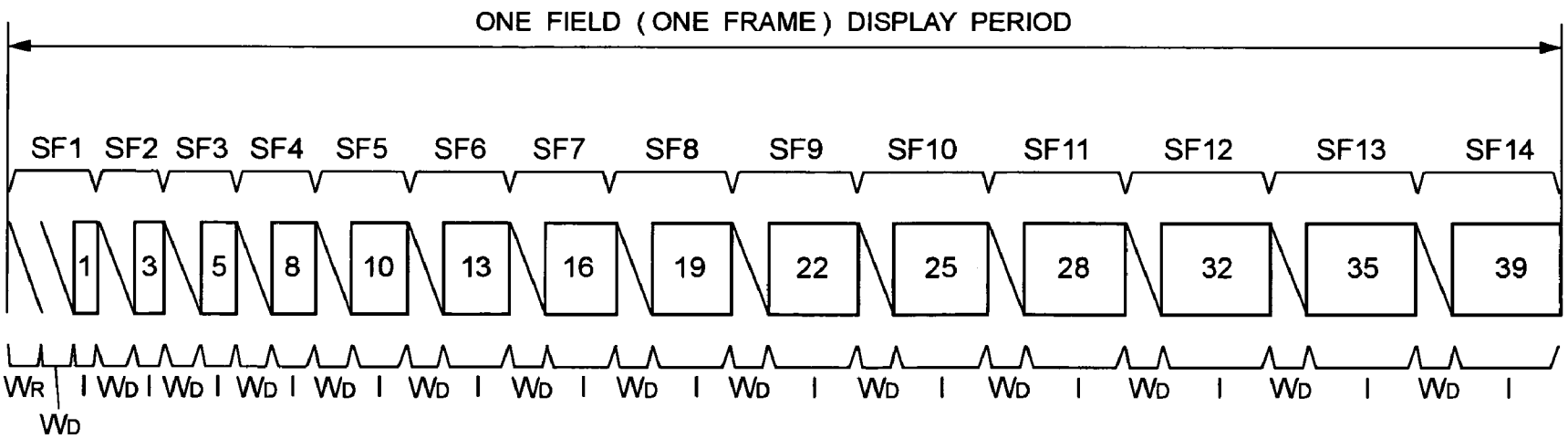
FIG. 14 is a diagram showing a modified example of the light emission driving format shown in FIG. 10.

FIG. 14 is a diagram showing a modified example of the light emission driving format according to another embodiment of the invention, which has been made in view of the above-mentioned matters.

In the light emission driving format shown in FIG. 14, similar to that shown in FIG. 10, one field (or one frame) display period is divided into 14 subfields SF1 to SF14, and a positive polarity address erasing process $W_D$ and a sustain process I are sequentially performed in each of the subfields SF2 to SF14. However, in the light emission driving format shown in FIG. 14, the erasing process E is not included in the last subfield SF14. In addition, in the first subfield SF1, the sustain process I is performed after the positive polarity address erasing process $W_D$ immediately after the negative polarity address writing process $W_R$.

Figure 15:
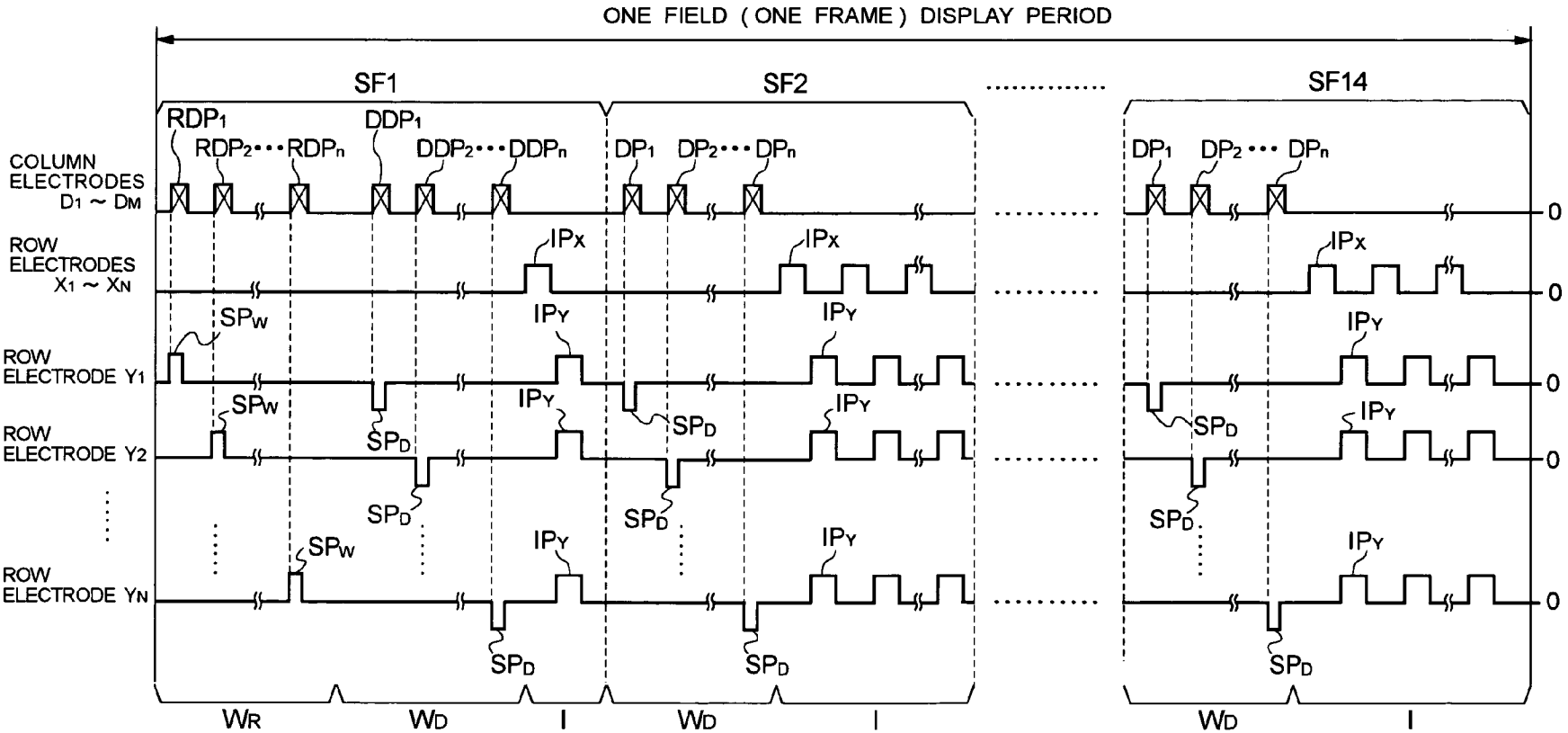
FIG. 15 is a diagram showing a further example of the various driving pulses supplied to the PDP 10 in accordance with the light emission driving format shown in FIG. 14, and timings at which the driving pulses are supplied.

FIG. 15 is a diagram showing various driving pulses supplied by each of the address driver 6, first sustain driver 7 and second sustain driver 8 to the column electrodes and row electrode pairs of the PDP 10 in accordance with the light emission driving format shown in FIG. 14, and timings at which the driving pulses are supplied.

In FIG. 15, in the negative polarity address writing process $W_R$ performed only for the first subfield SF1, the address driver 6 generates pixel data pulses having peak voltages corresponding to the pixel drive data bits $RDB_{(1, 1)}$ to $RDB_{(n, m)}$ read out from the memory 4. For example, the address driver 6 generates pixel data pulses having peak voltages of a positive polarity in the case of the pixel drive data bits RDB with logic level "1" and generates pixel data pulses of a low voltage (0 volt) in the case of the pixel drive data bits RDB with logic level "0." Then, the address driver 6 groups the pixel data pulses for each display line into pixel data pulses groups $RDP_1$ to $RDP_n$ and sequentially supplies them to the column electrodes $D_1$ to $D_m$ of the PDP 10, as shown in FIG. 15. Further, in the negative polarity address writing process $W_R$, the second sustain driver 8 generates a positive polarity scan pulses $SP_W$ in synchronization with the supply of the pixel data pulses groups $RDP_1$ to $RDP_n$ and sequentially supplies the scanning pulse $SP_W$ to the row electrodes $Y_1$ to $Y_n$, as shown in FIG. 15. In this event, a writing address discharge is produced only in those discharge cells at intersections of the row electrodes Y supplied with the positive polarity scan pulses $SP_W$ and the columns electrodes D supplied with the pixel data pulses of the low voltage (0 volt). In this way, wall electric charges are formed in the discharge cells in which the writing address discharge is produced, and the discharge cells are set to the light emitting cell state. Meanwhile, the writing address discharge as described above is not produced in those discharge cells supplied with the pixel data pulses having peak voltages of a positive polarity and the scan pulses $SP_W$. Therefore, the wall electric charges are not formed in the discharge cells, and the discharge cells are set to the non-light emitting cell state.

Next, in the positive polarity address erasing process $W_D$ performed in the first subfield SF1 at a period immediately after the negative polarity address writing process $W_R$, the address driver 6 generates pixel data pulses having peak voltages corresponding to the pixel drive data bits $RDB_{(1, 1)}$ to $RDB_{(n, m)}$ read out from the memory 4. For example, the address driver 6 generates pixel data pulses having peak voltages of a positive polarity in the case of the pixel drive data bits RDB with logic level "1" and generates pixel data pulses having peak voltages of the 0 voltage in the case of the pixel drive data bits RDB with logic level "0." Then, the address driver 6 groups the pixel data pulses for each display line into pixel data pulses groups $DDP_1$ to $DDP_n$ and sequentially supplies them to the column electrodes $D_1$ to $D_m$ of the PDP 10, as shown in FIG. 15. Further, in the positive polarity address erasing process $W_D$, the second sustain driver 8 generates a negative polarity scan pulses $SP_D$ in synchronization with the supply of the pixel data pulses groups $DDP_1$ to $DDP_n$ and sequentially supplies the scanning pulse $SP_D$ to the row electrodes $Y_1$ to $Y_n$, as shown in FIG. 15. In this event, an erasing address discharge is produced only in those discharge cells at intersections of the row electrodes Y supplied with the negative polarity scan pulses $SP_D$ and the columns electrodes D supplied with the pixel data pulses of the low voltage (0 volt). That is, the erasing address discharge is produced between the row electrodes Y and the column electrodes D in the discharge cells, in a state that the row electrodes Y are charged to a negative polarity and the column electrodes D serving as the address electrodes are charged to a positive polarity. Meanwhile, since the erasing address discharge as described above is not produced in those discharge cells supplied with the pixel data pulses of the low voltage and the scan pulses $SP_D$, the discharge cells maintain their cell states. That is, the discharge cells remain in the light emitting cell state in the case of the presence of the wall electric charges and remain in the non-light emitting cell state in the case of the absence of the wall electric charges.

That is, in the first subfield SF1, the erasing address discharge is produced in the positive polarity address erasing process $W_D$ in the case that the pixel drive data GD as shown in FIG. 9 has the first bit with logic level "1", i.e., in the case the first level gradation driving scheme for expressing the lowest luminance level (black luminance level) is performed, and the writing address discharge is produced in the negative polarity address writing process $W_R$ in the case of expressing gradation levels other than the lowest gradation level.

The operations in the sustain process I performed for the first subfield SF1 and the positive polarity address erasing process $W_D$ and sustain process I performed for the subfields SF2 to SF14 are the same as those described in connection with FIGS. 10 and 11, and the descriptions thereof will be omitted.

Figure 16A:
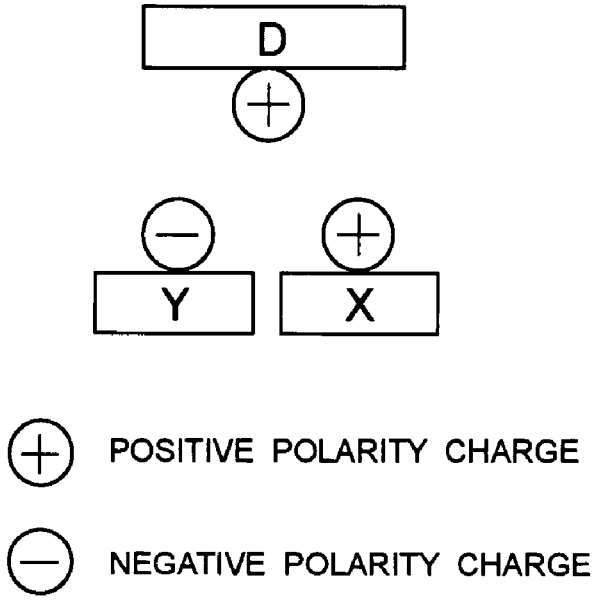
FIGS. 16A and 16B are schematic diagrams showing a charge formation state in discharge cells at a period immediately before the first subfield SF1.
Figure 16B:
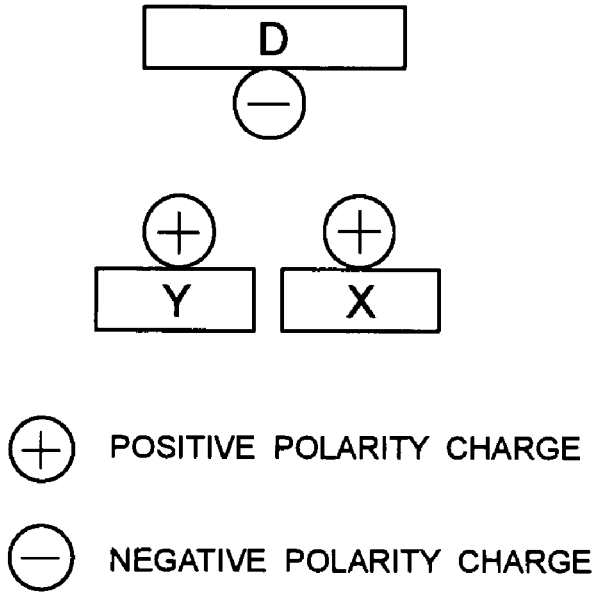

Here, in the driving method shown in FIGS. 14 and 15, the erasing process E is not performed in the last subfield SF14 immediately after the sustain process I. Therefore, at a period immediately before the first subfield SF1, those discharge cells having wall electric charges remaining thereon coexist with those discharge cells having no wall electric charges remaining thereon. In this event, in those discharge cells in their light emitting cell states, positive electric charges are formed on the row electrodes X, negative electric charges are formed on the row electrodes Y, and positive electric charges are formed on the column electrodes D, as shown in FIG. 16A. Meanwhile, in those discharge cells in their non-light emitting cell states, the same positive electric charges are formed on the row electrodes X and Y, and negative electric charges are formed on the column electrodes D, as shown in FIG. 16B.

FIGS. 17A to 17C are schematic diagrams showing the polarity changes in the electric charges formed on the column electrodes D and the row electrodes X and Y in each discharge cell in the unit display period in a case where the discharge cells are in the light emitting cell state as shown in FIG. 16A at a period immediately before the first subfield SF1.

FIG. 17A shows the polarity changes in electric charges in the discharge cells in the case of the 15-level gradation driving scheme for expressing the highest luminance level as shown in FIG. 9.

In the 15-level gradation driving scheme, in order to produce the writing address discharge (indicated by the double circles) in the first subfield SF1 as shown in FIG. 9, in the negative polarity address writing process $W_R$, the scan pulses $SP_W$ of a positive polarity voltage are supplied to the row electrodes Y and the pixel data pulses RDP of the 0 voltage is supplied to the column electrodes D. However, in this event, since the discharge cells are in the light emitting cell state as shown in FIG. 16A (i.e., since negative electric charges are formed on the row electrodes Y and positive electric charges are formed on the column electrodes D), the writing address discharge is not produced in the discharge cells. Therefore, even after performing the negative polarity address writing process $W_R$ in the first subfield SF1, the negative electric charges remain in the row electrodes Y, the positive electric charges remain in the row electrodes X, and the positive electric charges remain in the column electrodes D, respectively, as shown in FIG. 17A. Subsequently, in the positive polarity address erasing process $W_D$ for the first subfield SF1, the scan pulses $SP_D$ of a negative polarity voltage are supplied to the row electrodes Y and the pixel data pulses DDP of the 0 voltage are supplied to the column electrodes D. Therefore, the discharge is not produced in the positive polarity address erasing process $W_D$ and, even after the positive polarity address erasing process $W_D$, the negative electric charges remain in the row electrodes Y, the positive electric charges remain in the row electrodes X, and the positive electric charges remain in the column electrodes D. In the sustain process I for each of the subfields SF1 to SF14, the sustain discharge is produced between the row electrodes X and the row electrodes Y in the discharge cells whenever the sustain pulses IP of a positive polarity voltage are alternately supplied to the row electrodes X and Y. In this event, the sustain pulses $IP_Y$ supplied to the electrodes Y is the last one of the sustain pulses $IP_X$ and $IP_Y$ supplied to the row electrodes X and Y in the sustain process I. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. That is, according to the 15-level gradation driving scheme, at a period immediately after performing the sustain process I for the last subfield SF14, in the discharge cells, positive electric charges remain in the vicinity of the row electrodes X, negative electric charges remain in the vicinity of the row electrodes Y, and positive electric charges remain in the vicinity of the column electrodes D, as shown in FIG. 17A.

FIG. 17B shows the polarity changes in electric charges in the discharge cells in the case of the second to 14-th level gradation driving scheme as shown in FIG. 9.

In the gradation driving scheme, in order to produce the writing address discharge (indicated by the double circles) in the first subfield SF1 as shown in FIG. 9, in the negative polarity address writing process $W_R$, the scan pulses $SP_W$ of a positive polarity voltage are supplied to the row electrodes Y and the pixel data pulses RDP of the 0 voltage is supplied to the column electrodes D. However, in this event, since the discharge cells are in the light emitting cell state as shown in FIG. 16A, (i.e., since negative electric charges are formed on the row electrodes Y and positive electric charges are formed on the column electrodes D), the writing address discharge is not produced in the discharge cells. Therefore, even after performing the negative polarity address writing process $W_R$ in the first subfield SF1, the negative electric charges remain in the row electrodes Y, the positive electric charges remain in the row electrodes X, and the positive electric charges remain in the column electrodes D, as shown in FIG. 17B. Subsequently, in the positive polarity address erasing process $W_D$ for the first subfield SF1, the scan pulses $SP_D$ of a negative polarity voltage are supplied to the row electrodes Y and the pixel data pulses DDP of the 0 voltage are supplied to the column electrodes D. Therefore, the discharge is not produced in the positive polarity address erasing process $W_D$ and, even at a period immediately after the positive polarity address erasing process $W_D$, the negative electric charges remain in the row electrodes Y, the positive electric charges remain in the row electrodes X, and the positive electric charges remain in the column electrodes D. In the sustain process I for the first subfield SF1, the sustain discharge is produced between the row electrodes X and the row electrodes Y in the discharge cells whenever the sustain pulses IP of a positive polarity voltage are alternately supplied to the row electrodes X and Y. In this event, the sustain pulses $IP_Y$ supplied to the electrodes Y is the last one of the sustain pulses $IP_X$ and $IP_Y$ supplied to the row electrodes X and Y in the sustain process I. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. In this case, as shown in FIG. 9, in the second to 14-th level gradation driving scheme, the erasing address discharge (indicated by the dark circles) is produced in the positive polarity address erasing process $W_D$ for one subfield of the SF2 to SF14. That is, in the positive polarity address erasing process $W_D$ for the one subfield of the SF2 to SF14, an erasing address discharge is produced between the row electrodes Y and the column electrodes D in the discharge cells, in a state that the column electrodes D in the discharge cells are charged to a positive polarity in accordance with the supply of the scan pulses $SP_D$ of a negative polarity voltage to the row electrodes Y and the pixel data pulses DP of a positive polarity voltage to the column electrodes D. In this way, at a period after performing the positive polarity address erasing process $W_D$ in the one subfield, in the discharge cells, the same positive electric charges are formed in the vicinity of the row electrodes X and Y, and negative electric charges are formed in the vicinity of the column electrodes D. In this event, since the electric charges formed on the row electrodes X and Y have the same polarity, the discharge cells are in the non-light emitting cell state. Therefore, in the sustain process I for each of the subfields SF2 to SF14 at a period immediately before the production of the erasing address discharge, the sustain discharge is produced between the row electrodes X and the row electrodes Y in the discharge cells whenever the sustain pulses IP of a positive polarity voltage are alternately supplied to the row electrodes X and Y in this order. In this event, the sustain pulses $IP_Y$ supplied to the electrodes Y is the last one of the sustain pulses $IP_X$ and $IP_Y$ supplied to the row electrodes X and Y in the sustain process I for each subfield. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. Meanwhile, in the sustain process I for the subfield at which the erasing address discharge is produced and subsequent subfields, the sustain discharge is not produced even when the sustain pulses IP of a positive polarity voltage are alternately supplied to the row electrodes X and Y in this order. Therefore, at a period after performing the sustain process I for each subfield, in the discharge cells, positive electric charges are formed in the vicinity of the row electrodes X and Y, and negative electric charges are formed in the vicinity of the column electrodes D, as shown in FIG. 17B.

FIG. 17C shows the polarity changes in electric charges in the discharge cells in the case of the first level gradation driving scheme for expressing the lowest luminance level (black luminance level) as shown in FIG. 9.

In the first level gradation driving scheme, in the negative polarity address writing process $W_R$ for the first subfield SF1, the scan pulses $SP_W$ of a positive polarity voltage are supplied to the row electrodes Y and the pixel data pulses RDP of a positive polarity voltage is supplied to the column electrodes D. Therefore, the writing address discharge is not produced in the negative polarity address writing process $W_R$ and, even after the negative polarity address writing process $W_R$, the negative electric charges remain in the row electrodes Y, the positive electric charges remain in the row electrodes X, and the positive electric charges remain in the column electrodes D, as shown in FIG. 17C. Subsequently, in the positive polarity address erasing process $W_D$ for the first subfield SF1, the scan pulses $SP_D$ of a negative polarity voltage are supplied to the row electrodes Y and the pixel data pulses DDP of a positive polarity voltage are supplied to the column electrodes D. Therefore, in the positive polarity address erasing process $W_D$, the address erasing discharge is produced between the row electrodes Y and the column electrodes D in a state that the row electrodes Y are charged to a negative polarity and the column electrodes D are charged to a positive polarity. In this way, at a period after performing the positive polarity address erasing process $W_D$ in the first subfield SF1, the discharge cells are set to the non-light emitting cell state in which the same positive electric charges are formed on the row electrodes X and Y and the negative electric charges are formed on the column electrodes D. Therefore, since the discharge is not produced in a period after performing the positive polarity address erasing process $W_D$ in the first subfield SF1, the discharge cells maintain their non-light emitting cell states until the last subfield SF14, as shown in FIGS. 16A and 16B. That is, the same positive electric charges remain in the row electrodes X and Y and the negative electric charges remain in the column electrodes D.

Figure 18A:
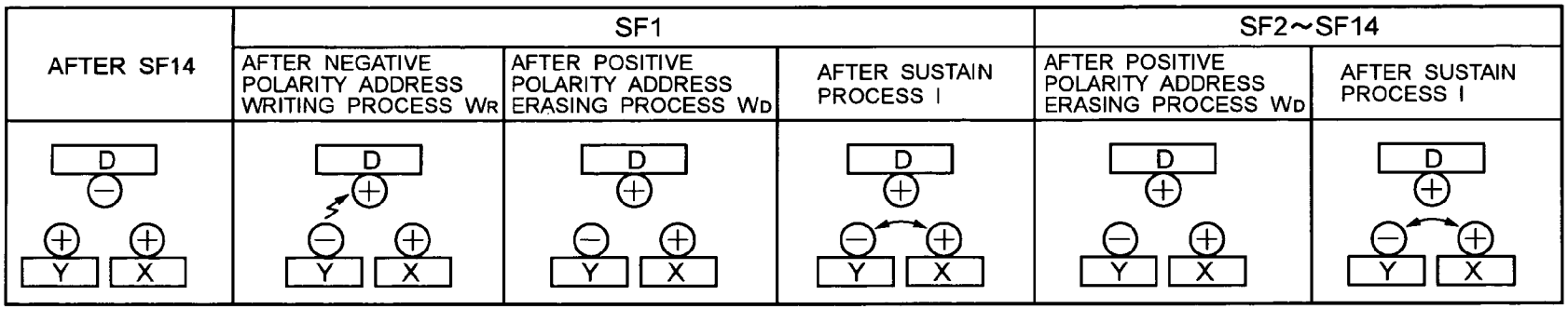
FIGS. 18A to 18C are schematic diagrams showing the polarity changes in the electric charges formed on the column electrodes D and the row electrodes X and Y in each discharge cell in a case where the discharge cells are in the charge formation state as shown in FIG. 16B at a period immediately before the first subfield SF1.
Figure 18B:
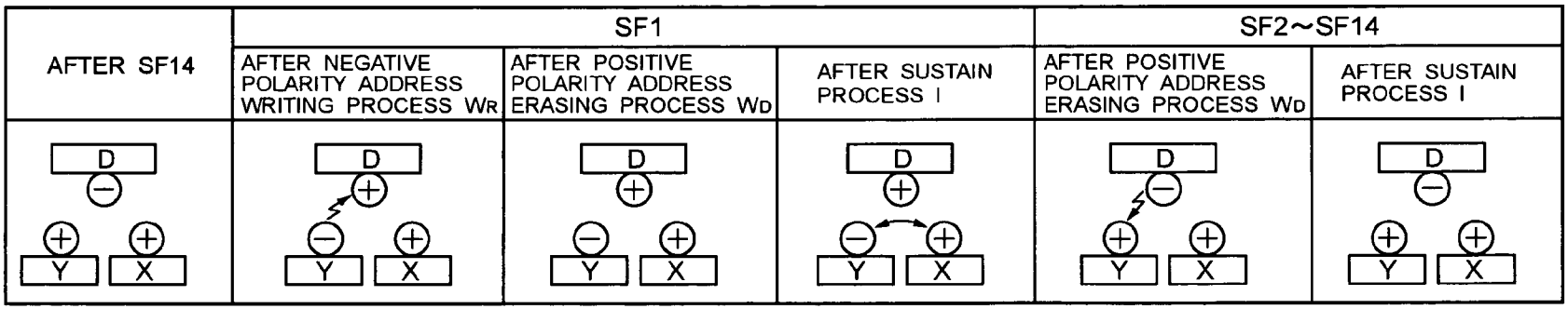
Figure 18C:
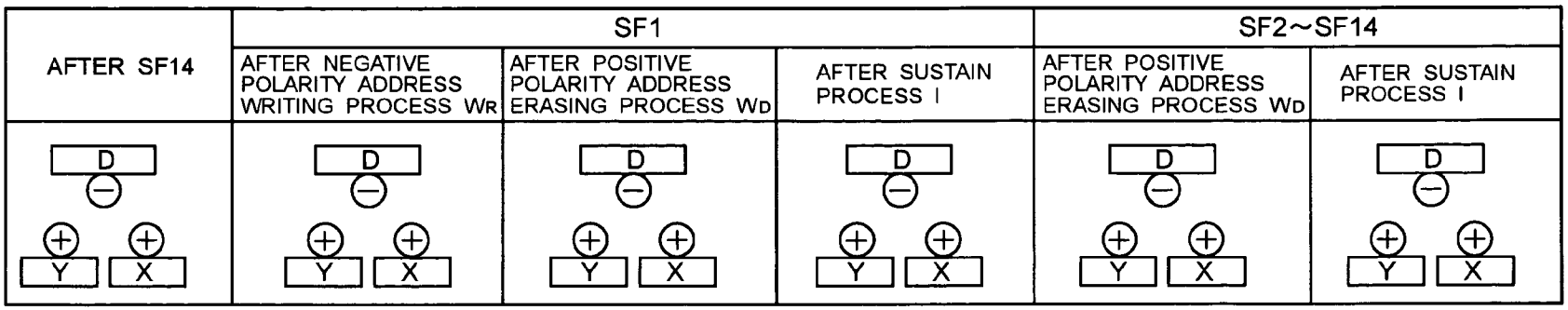

FIGS. 18A to 18C are schematic diagrams showing the polarity changes in the electric charges formed on the column electrodes D and the row electrodes X and Y in each discharge cell in a case where the discharge cells are in the non-light emitting cell state as shown in FIG. 16B at a period immediately before the first subfield SF1.

FIG. 18A shows the polarity changes in electric charges in the discharge cells in the case of the 15-level gradation driving scheme for expressing the highest luminance level as shown in FIG. 9.

In the 15-level gradation driving scheme, in order to produce the writing address discharge (indicated by the double circles) in the first subfield SF1 as shown in FIG. 9, in the negative polarity address writing process $W_R$, the scan pulses $SP_W$ of a positive polarity voltage are supplied to the row electrodes Y and the pixel data pulses RDP of the 0 voltage is supplied to the column electrodes D. In this event, since the discharge cells are in the non-light emitting cell state as shown in FIG. 16B, (i.e., since the same positive electric charges are formed on the row electrodes X and Y and negative electric charges are formed on the column electrodes D), the writing address discharge is produced between the row electrodes Y and the column electrodes D in a state that the column electrodes D is charged to a negative polarity. Therefore, at a period after performing the negative polarity address writing process $W_R$ in the first subfield SF1, the negative electric charges remain in the row electrodes Y, the positive electric charges remain in the row electrodes X, and the positive electric charges remain in the column electrodes D, respectively, as shown in FIG. 18A. Subsequently, in the positive polarity address erasing process $W_D$ for the first subfield SF1, the scan pulses $SP_D$ of a negative polarity voltage are supplied to the row electrodes Y and the pixel data pulses DDP of the 0 voltage are supplied to the column electrodes D. Therefore, the discharge is not produced in the positive polarity address erasing process $W_D$ and, even after the positive polarity address erasing process $W_D$, the negative electric charges remain in the row electrodes Y, the positive electric charges remain in the row electrodes X, and the positive electric charges remain in the column electrodes D. In the sustain process I for each of the subfields SF1 to SF14, the sustain discharge is produced between the row electrodes X and the row electrodes Y in the discharge cells whenever the sustain pulses IP of a positive polarity voltage are alternately supplied to the row electrodes X and Y. In this event, the sustain pulses $IP_Y$ supplied to the electrodes Y is the last one of the sustain pulses $IP_X$ and $IP_Y$ supplied to the row electrodes X and Y in the sustain process I. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. That is, according to the 15-level gradation driving scheme, at a period immediately after performing the sustain process I for the last subfield SF14, in the discharge cells, positive electric charges remain in the vicinity of the row electrodes X, negative electric charges remain in the vicinity of the row electrodes Y, and positive electric charges remain in the vicinity of the column electrodes D, as shown in FIG. 18A.

FIG. 18B shows the polarity changes in electric charges in the discharge cells in the case of the second to 14-th level gradation driving scheme as shown in FIG. 9.

In the gradation driving scheme, in order to produce the writing address discharge (indicated by the double circles) in the first subfield SF1 as shown in FIG. 9, in the negative polarity address writing process $W_R$, the scan pulses $SP_W$ of a positive polarity voltage are supplied to the row electrodes Y and the pixel data pulses RDP of the 0 voltage is supplied to the column electrodes D. In this event, since the discharge cells are in the non-light emitting cell state as shown in FIG. 16B, (i.e., since the same positive electric charges are formed on the row electrodes X and Y and negative electric charges are formed on the column electrodes D), the writing address discharge is produced between the row electrodes Y and the column electrodes D in a state that the column electrodes D is charged to a negative polarity. Therefore, in a period after performing the negative polarity address writing process $W_R$ in the first subfield SF1, the negative electric charges remain in the row electrodes Y, the positive electric charges remain in the row electrodes X, and the positive electric charges remain in the column electrodes D, respectively, as shown in FIG. 18B. Subsequently, in the positive polarity address erasing process $W_D$ for the first subfield SF1, the scan pulses $SP_D$ of a negative polarity voltage are supplied to the row electrodes Y and the pixel data pulses DDP of the 0 voltage are supplied to the column electrodes D. Therefore, the discharge is not produced in the positive polarity address erasing process $W_D$ and, even at a period immediately after the positive polarity address erasing process $W_D$, the negative electric charges remain in the row electrodes Y, the positive electric charges remain in the row electrodes X, and the positive electric charges remain in the column electrodes D. In the sustain process I for the first subfield SF1, the sustain discharge is produced between the row electrodes X and the row electrodes Y in the discharge cells whenever the sustain pulses IP of a positive polarity voltage are alternately supplied to the row electrodes X and Y. In this event, the sustain pulses $IP_Y$ supplied to the electrodes Y is the last one of the sustain pulses $IP_X$ and $IP_Y$ supplied to the row electrodes X and Y in the sustain process I. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. In this case, as shown in FIG. 9, in the second to 14-th level gradation driving scheme, the erasing address discharge (indicated by the dark circles) is produced in the positive polarity address erasing process $W_D$ for one subfield of the SF2 to SF14. That is, in the positive polarity address erasing process $W_D$ for the one subfield of the SF2 to SF14, an erasing address discharge is produced between the row electrodes Y and the column electrodes D in the discharge cells, in a state that the column electrodes D in the discharge cells are charged to a positive polarity in accordance with the supply of the scan pulses $SP_D$ of a negative polarity voltage to the row electrodes Y and the pixel data pulses DP of a positive polarity voltage to the column electrodes D. In this way, at a period after performing the positive polarity address erasing process $W_D$ in the one subfield, in the discharge cells, the same positive electric charges are formed in the vicinity of the row electrodes X and Y, and negative electric charges are formed in the vicinity of the column electrodes D. In this event, since the electric charges formed on the row electrodes X and Y have the same polarity, the discharge cells are in the non-light emitting cell state. Therefore, in the sustain process I for each of the subfields SF2 to SF14 at a period immediately before the production of the erasing address discharge, the sustain discharge is produced between the row electrodes X and the row electrodes Y in the discharge cells whenever the sustain pulses IP of a positive polarity voltage are alternately supplied to the row electrodes X and Y in this order. In this event, the sustain pulses $IP_Y$ supplied to the electrodes Y is the last one of the sustain pulses $IP_X$ and $IP_Y$ supplied to the row electrodes X and Y in the sustain process I for each subfield. Therefore, at a period after performing the sustain process I, in the discharge cells, positive electric charges are formed in the vicinity of the row electrodes X, negative electric charges are formed in the vicinity of the row electrodes Y, and positive electric charges are formed in the vicinity of the column electrodes D, respectively. Meanwhile, in the sustain process I for the subfield at which the erasing address discharge is produced and subsequent subfields, the sustain discharge is not produced even when the sustain pulses IP of a positive polarity voltage are alternately supplied to the row electrodes X and Y in this order. Therefore, at a period after performing the sustain process I for each subfield, in the discharge cells, the same positive electric charges are formed in the vicinity of the row electrodes X and Y, and negative electric charges are formed in the vicinity of the column electrodes D, as shown in FIG. 18B.

FIG. 18C shows the polarity changes in electric charges in the discharge cells in the case of the first level gradation driving scheme for expressing the lowest luminance level (black luminance level) as shown in FIG. 9.

In the first level gradation driving scheme, in the negative polarity address writing process $W_R$ for the first subfield SF1, the scan pulses $SP_W$ of a positive polarity voltage are supplied to the row electrodes Y and the pixel data pulses RDP of the positive polarity voltage is supplied to the column electrodes D. However, the writing address discharge is not produced in the negative polarity address writing process $W_R$. Therefore, even after the negative polarity address writing process $W_R$, the discharge cells are in the non-lighting cell state in which the positive electric charges remain in the row electrodes X and Y, and the negative electric charges remain in the column electrodes D, respectively, as shown in FIG. 18C. Subsequently, in the positive polarity address erasing process $W_D$ for the first subfield SF1, the scan pulses $SP_D$ of a negative polarity voltage are supplied to the row electrodes Y and the pixel data pulses DDP of a positive polarity voltage are supplied to the column electrodes D. However, the address erasing discharge is not produced in the positive polarity address erasing process $W_D$. That is, at a period even after performing positive polarity address erasing process $W_D$ in the first subfield SF1, the discharge cells maintain their non-lighting cell states in which the same positive electric charges remain in the row electrodes X and Y, and the negative electric charges remain in the column electrodes D, respectively, as shown in FIG. 18C. Thereafter, the discharge cells maintain their non-light emitting cell states until the last subfield SF14, as shown in FIG. 18C. That is, the same positive electric charges remain in the row electrodes X and Y and the negative electric charges remain in the column electrodes D.

As described above, as shown in FIG. 15, the positive polarity address erasing process $W_D$ is performed immediately after the negative polarity address writing process $W_R$ for the first subfield SF1. According to the driving method, the polarity states of electric charges of the row electrodes X and Y and the column electrodes D in the discharge cells at a period immediately before the first subfield SF1 allow various discharging operations to be securely produced even in those states shown in either FIG. 16A or FIG. 16B. That is, even when the erasing process E for setting the polarities of electric charges of the row electrodes X and Y and the column electrodes D in the discharge cells at a period immediately before the first subfield SF1 to those states shown in FIG. 16A is not performed, it is possible to securely produce various discharge operations and implement the display driving with an improved dark contrast, similar to the case of the driving method as shown in FIG. 11.

When implementing the driving method shown in FIG. 15, the pixel data pulses to be supplied to the column electrodes D in the positive polarity address erasing process $W_D$ may have a negative polarity voltage similar to the case of that shown in FIG. 13. In this event, similar to the scan pulses $SP_{WP}$ shown in FIG. 13, the peak voltages of the scan pulses $SP_W$ to supplied to the row electrodes Y in the positive polarity address writing process $W_R$ is decreased to a value at which the discharge is not produced in the case of the column electrodes D having the 0 voltage.

In the embodiments described above, as shown in FIG. 9, although the 15-level gradation driving scheme is implemented in accordance with 15 types of light emission driving patterns, a 16-level gradation driving scheme (that is one level added version of the 15-level gradation driving method) may be implemented by adopting the light emission driving format shown in FIG. 14.

That is, a light emission driving pattern in which the address writing discharge and the address erasing discharge are produced only in the negative polarity address writing process $W_R$ and the positive address erasing process $W_D$ only for the first subfield SF1 of the entire subfields SF1 to SF14 is added to the 15 types of light emission driving patterns shown in FIG. 9.

Figure 19:
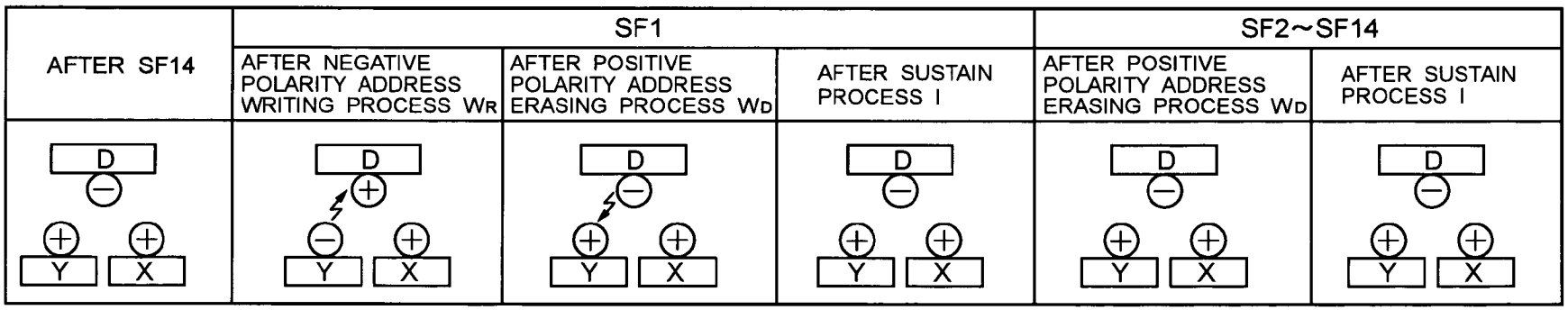
FIG. 19 is a schematic diagram showing the polarity changes in the electric charges formed on the column electrodes D and the row electrodes X and Y in each discharge cell when it is driven to express a luminance level corresponding to a gradation between a first level and a second level, shown in FIG. 9.

FIG. 19 is a diagram showing the polarity changes in the electric charges formed on the column electrodes D and the row electrodes X and Y in each discharge cell when it is driven in accordance with the light emission driving patterns.

As shown in FIG. 19, according to the new light emission driving patterns, in the negative polarity address writing process $W_R$ for the first subfield SF1, the writing address discharge is produced in a state that the column electrodes D are charged to a negative polarity, and positive polarity charges are formed in the vicinity of the column electrodes D, negative polarity charges are formed in the vicinity of the row electrodes Y, and positive polarity charges are formed in the vicinity of the row electrodes X, respectively. Next, in the positive polarity address erasing process $W_D$ for the first subfield SF1, the writing address discharge is produced in a state that the column electrodes D are charged to a positive polarity, and negative polarity charges are formed in the vicinity of the column electrodes D, and the same positive polarity charges are formed in the vicinity of the row electrodes X and Y, respectively. Therefore, in the sustain process I for each of the subfields SF1 to SF14, the sustain discharge is not produced even when the sustain pulses IP of a positive polarity are supplied to the row electrodes X and Y. Therefore, in a period ranging from the first subfield SF1 and the last subfield SF14, the discharge cells maintain their non-light emitting cell states in which the same positive electric charges are formed on the row electrodes X and Y and the negative electric charges are formed on the column electrodes D, respectively, as shown in FIG. 19. In this way, according to the driving method described above, since the sustain discharge is not produced in a period ranging from the first subfield SF1 to the last subfield SF14 but only the discharge accompanied by the address writing discharge and the address erasing discharge is produced, it is possible to express a luminance level corresponding to a gradation between a first level and a second level shown in FIG. 9, thereby increasing resolution for expressing a dark luminance level. In order to implement the driving method in accordance with the new light emission driving patterns, the polarity states of electric charges in the discharge cells at a period immediately before the implementation (i.e., at a period after the last subfield SF14 of the previous frame) need to be the same as those states as shown in FIG. 16B. Therefore, for the implementation of the new light emission driving patterns, the drive control circuit 2 needs to determine whether or not the electric charges in the discharge cells at a period after the last subfield SF14 have the same polarity state as those shown in FIG. 16B. When the electric charges have the same polarity state as those shown in FIG. 16B, the drive control circuit 2 implements the driving scheme in which the address writing discharge and the address erasing discharge are produced in the first subfield SF1, as described above. Meanwhile, when the electric charges does not have the same polarity state as those shown in FIG. 16B, the drive control circuit 2 implements the second level gradation driving scheme shown in FIG. 9. When the erasing process E is performed in the last subfield SF14, as shown in FIG. 10, the above-described control of the drive control circuit 2 is not required since the electric charges in the discharge cells in a period after the last subfield SF14 always have the polarity states as shown in FIG. 16B.

In the embodiments described above, in setting the discharge cells to a state in accordance with the pixel data, when changing the states of the discharge cells from the non-light emitting cell state to the light emitting cell state, the writing address discharge is produced between the row electrodes Y and the column electrodes D in a state that the column electrodes D are charged to a negative polarity (the negative polarity address writing process $W_R$). Meanwhile, when changing the states of the discharge cells from the light emitting cell state to the non-light emitting cell state, the erasing address discharge is produced between the row electrodes Y and the column electrodes D in a state that the column electrodes D are charged to a positive polarity (the positive polarity address erasing process $W_D$).

However, when changing the states of the discharge cells from the non-light emitting cell state to the light emitting cell state, the writing address discharge may be produced between the row electrodes Y and the column electrodes D in a state that the column electrodes D are charged to a positive polarity. Meanwhile, when changing the states of the discharge cells from the light emitting cell state to the non-light emitting cell state, the erasing address discharge may be produced between the row electrodes Y and the column electrodes D in a state that the column electrodes D are charged to a negative polarity.

Figure 20:
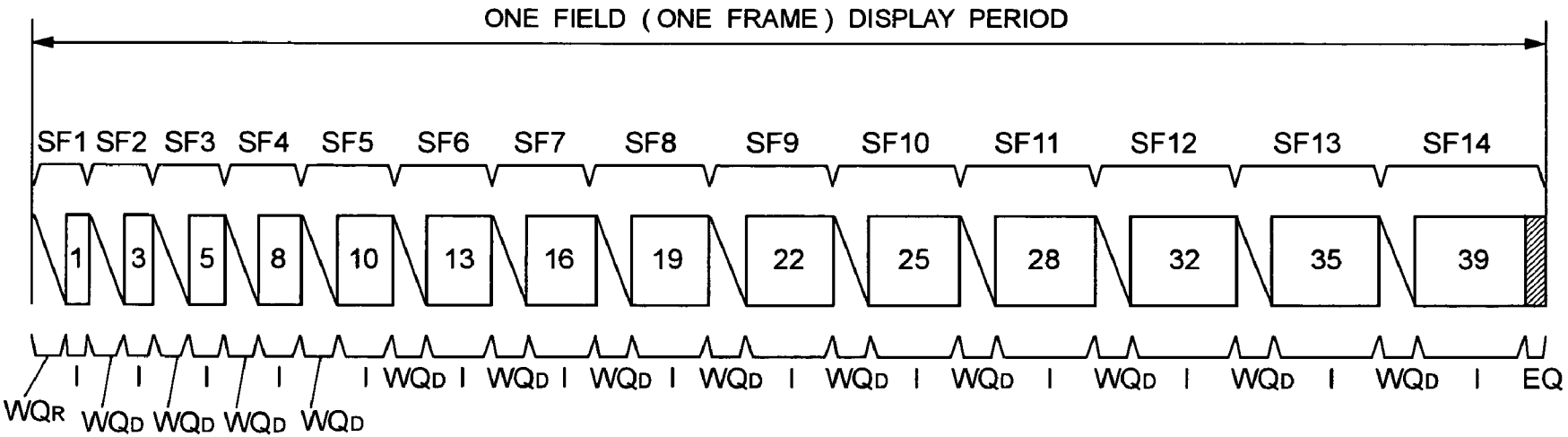
FIG. 20 is a diagram showing another example of the light emission driving format based on the driving method of the invention.

FIG. 20 is a diagram showing an example of the light emission driving format, which has been made in view of the above-mentioned matters.

In the light emission driving format shown in FIG. 20, similar to the case of FIG. 10, the sustain process I for producing a sustain discharge in those discharge cells in their light emitting cell states to emit light by a number of times corresponding to the number of light emissions allocated in correspondence with a luminance weighting factor for each of the subfields is performed in each of the fourteen subfields SF1 to SF14 of one field (or one frame) display period. In this event, the positive polarity address writing process $WQ_R$ is performed in the first subfield SF1 and the negative polarity address erasing process $WQ_D$ is performed in each of the remaining subfields SF2 to SF14, respectively. The erasing process EQ is performed only in the last subfield SF14.

Figure 21:
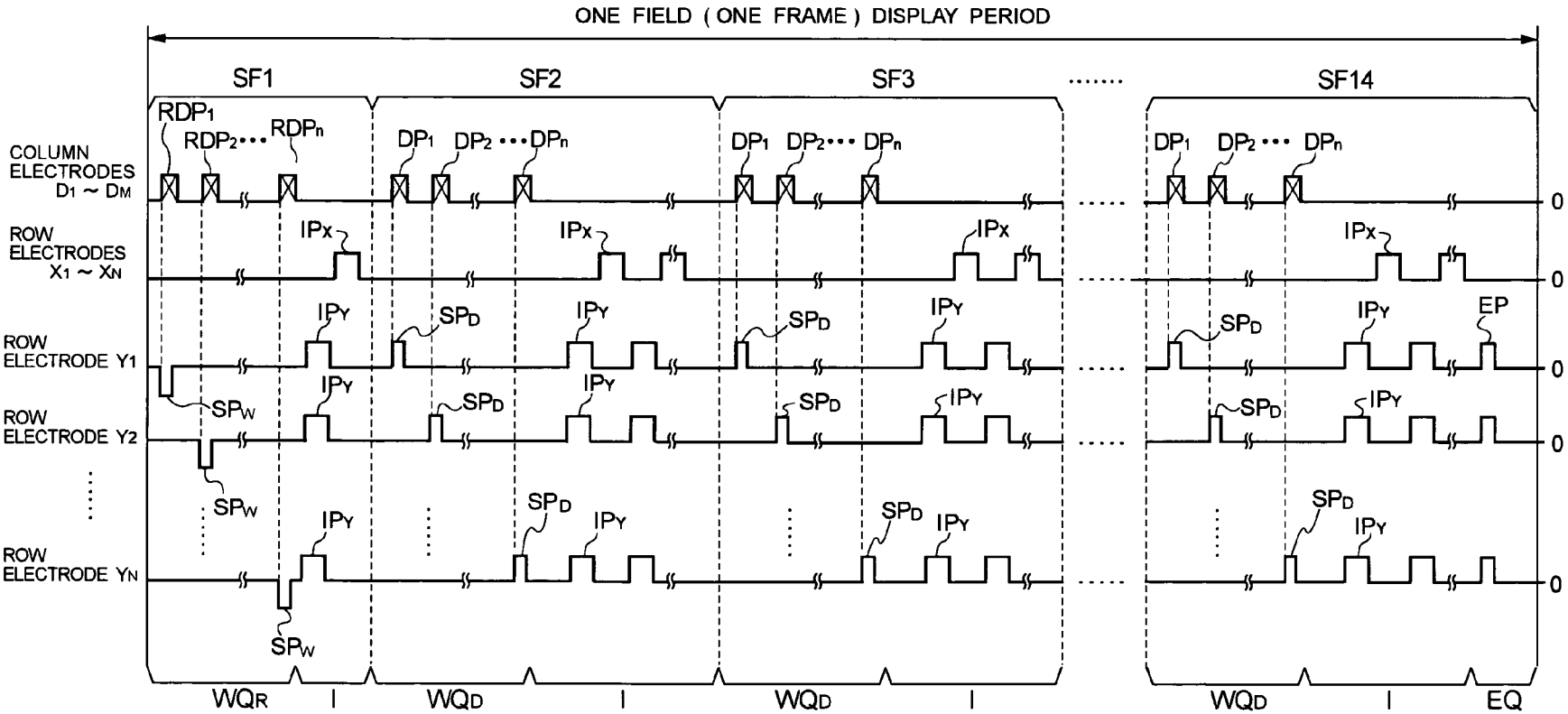
FIG. 21 is a diagram showing an example of the various driving pulses supplied to the PDP 10 in accordance with the light emission driving format shown in FIG. 20, and timings at which the driving pulses are supplied.

FIG. 21 is a diagram showing various driving pulses supplied by each of the address driver 6, first sustain driver 7 and second sustain driver 8 to the column electrodes and row electrode pairs of the PDP 10 in accordance with the light emission driving format shown in FIG. 20, and timings at which the driving pulses are supplied.

In FIG. 21, in the positive polarity address writing process $WQ_R$ performed only for the first subfield SF1, the address driver 6 generates pixel data pulses having peak voltages corresponding to the pixel drive data bits $RDB_{(1, 1)}$ to $RDB_{(n, m)}$ read out from the memory 4. For example, the address driver 6 generates pixel data pulses having peak voltages of a positive polarity in the case of the pixel drive data bits RDB with logic level "0" and generates pixel data pulses having peak voltages of the 0 voltage in the case of the pixel drive data bits RDB with logic level "1." Then, the address driver 6 groups the pixel data pulses for each display line into pixel data pulses groups $RDP_1$ to $RDP_n$ and sequentially supplies them to the column electrodes $D_1$ to $D_m$ of the PDP 10, as shown in FIG. 21. Further, in the positive polarity address writing process $WQ_R$, the second sustain driver 8 generates a negative polarity scan pulses $SP_W$ in synchronization with the supply of the pixel data pulses groups $RDP_1$ to $RDP_n$ and sequentially supplies the scanning pulse $SP_W$ to the row electrodes $Y_1$ to $Y_n$, as shown in FIG. 21. In this event, a writing address discharge is produced only in those discharge cells at intersections of the row electrodes Y supplied with the negative polarity scan pulses $SP_W$ and the columns electrodes D supplied with the pixel data pulses having high peak voltage of a positive polarity. That is, the writing address discharge is produced between the row electrodes Y and the column electrodes D in the discharge cells, in a state that the row electrodes Y are charged to a negative polarity and the column electrodes D serving as the address electrodes are charged to a positive polarity. In this way, wall electric charges are formed in the discharge cells in which the writing address discharge is produced, and the discharge cells are set to the light emitting cell state. Meanwhile, the writing address discharge as described above is not produced in those discharge cells supplied with the pixel data pulses of a low voltage (0 volt) and the scan pulses $SP_W$. Therefore, the wall electric charges are not formed in the discharge cells, and the discharge cells are set to a non-light emitting cell state where the sustain discharge cannot be produced in the sustain process I described later.

Here, whether or not the writing address discharge is produced in the positive polarity address writing process $WQ_R$ depends on the logic level of the first bit of the pixel drive data GD shown in FIG. 9. The first bit of the pixel drive data GD is at logic level "0" when the multi-gradation processed pixel data $PD_S$ is "0000", i.e., indicative of a luminance level "0", and the first bit thereof is at logic level "1" when the $PD_S$ indicates a luminance level other than the luminance level "0", as shown in FIG. 9. Then, the writing address discharge is produced only in a case where the first bit of the pixel drive data GD is at logic level "0".

In this way, in the positive polarity address writing process $WQ_R$, the pixel data pulses having peak voltages of a positive polarity are supplied to the discharge cells corresponding to the pixel data for expressing a luminance level greater than the luminance level "0", whereby the writing address discharge is produced in the discharge cells so that the discharge cells are set to the light emitting cell state. Meanwhile, the pixel data pulses having peak voltages of a low voltage (0 volt) are supplied to the discharge cells corresponding to the pixel data for expressing the luminance level "0", whereby the writing address discharge is not produced in the discharge cells so that the discharge cells are set to the non-light emitting cell state. That is, since it is basically unnecessary to set the discharge cells to the light emitting cell state when expressing the luminance level "0", the pixel data pulses of a low voltage are supplied to the discharge cells so that the writing address discharge is not produced in the discharge cells. In this way, it is possible to improve the dark contrast compared with the case where the address discharge for forming the wall electric charges is produced in the entire discharge cells even when expressing the luminance level "0".

Meanwhile, in FIG. 21, in the negative polarity address erasing process $WQ_D$ performed in each of the remaining subfields SF2 to SF14, the address driver 6 generates pixel data pulses having peak voltages corresponding to the pixel drive data bits $DB_{(1, 1)}$ to $DB_{(n, m)}$ read out from the memory 4. For example, the address driver 6 generates pixel data pulses having peak voltages of a positive polarity in the case of the pixel drive data bits DB with logic level "0" and generates pixel data pulses having peak voltages of the 0 voltage in the case of the pixel drive data bits DB with logic level "1." Then, the address driver 6 groups the pixel data pulses for each display line into pixel data pulses groups $DP_1$ to $DP_n$ and sequentially supplies them to the column electrodes $D_1$ to $D_m$ of the PDP 10, as shown in FIG. 21. Further, in the positive polarity address writing process $WQ_R$, the second sustain driver 8 generates a negative polarity scan pulses $SP_D$ in synchronization with the supply of the pixel data pulses groups $DP_1$ to $DP_n$ and sequentially supplies the scanning pulse $SP_D$ to the row electrodes $Y_1$ to $Y_n$, as shown in FIG. 21. In this event, an erasing address discharge is produced only in those discharge cells at intersections of the row electrodes Y supplied with the positive polarity scan pulses $SP_D$ and the columns electrodes D supplied with the pixel data pulses having peak voltages of the 0 volt. That is, the erasing address discharge is produced between the row electrodes Y and the column electrodes D in the discharge cells, in a state that the row electrodes Y are charged to a positive polarity and the column electrodes D serving as the address electrodes are charged to a negative polarity. In this way, the wall electric charges remaining on the discharge cells are erased by the production of the erasing address discharge, and the discharge cells are set to the non-light emitting cell. Meanwhile, since the erasing address discharge as described above is not produced in those discharge cells supplied with the pixel data pulses having peak voltages of a positive polarity and the scan pulses $SP_D$, the discharge cells maintain their cell states. That is, the discharge cells remain in the light emitting cell state in the case of the presence of the wall electric charges and remain in the non-light emitting cell state in the case of the absence of the wall electric charges.

Here, whether or not the erasing address discharge is produced in the negative polarity address erasing process $WQ_D$ depends on the respective logic level of the second to 14-th bits of the pixel drive data GD corresponding to the subfields SF2 to SF14, as shown in FIG. 9. That is, the erasing address discharge is produced in the negative polarity address erasing process $WQ_D$ for the subfields SF corresponding to the bit of the pixel drive data GD, only in a case where the corresponding bit of the pixel drive data is at logic level "1".

Next, in the sustain process I performed for each of the subfields SF1 to SF14, each of the first sustain driver 7 and the second sustain driver 8 repeatedly supplies the sustain pulses $IP_X$ and $IP_Y$ of a positive polarity to the row electrodes $X_1$ to $X_n$ and $Y_1$ to $Y_n$ in alternation, as shown in FIG. 21. In this event, the number of times the sustain pulses IP should be supplied in each sustain process I is determined on the basis of a weighting factor for the gradation luminance of each subfield. For example, as shown in FIG. 20, assuming that the number of light emissions is "1" in the first subfield SF1, the number of light emissions in the sustain process I for each subfield is as follow:

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

With the sustain process I, the sustain discharge is produced only in those discharge cells having the wall electric charges remaining thereon, i.e., only those in the light emitting cell state whenever the sustain pulses $IP_X$ and $IP_Y$ are supplied thereto. In this case, the light emissions accompanied by the sustain discharge in the discharge cells are repeated by the above-mentioned number of times (periods).

Next, in the erasure process EQ performed only for the last subfield SF14 of one field (or one frame) display period, the second sustain driver 8 supplies erasure pulses EP of a positive polarity to the row electrodes $Y_1$ to $Y_n$, as shown in FIG. 21. Therefore, an erasing discharge for erasing the wall electric charges is produced between the row electrodes Y and the column electrodes D in the discharge cells having the wall electric charges remaining thereon, in a state that the row electrodes Y are charged to a positive polarity and the column electrodes D are charged to a negative polarity. Accordingly, with the erasing process E, the entire discharge cells are set to the non-light emitting cell state where the wall electric charges are not present.

As described above, by repeating those operations as shown in FIGS. 9, 20, and 21 in each field (frame), a luminance level corresponding to the total number of light emissions caused in the sustain process I for each of the subfields SF in each field display period can be expressed on the screen. According to the light emission driving format as shown in FIG. 20, a chance for setting the discharge cells to the light emitting cell state exist only in the negative polarity address writing process $WQ_R$ for the first subfield SF1 of the one field (or one frame) display period. Here, according to the bit pattern of the pixel drive data GD as shown in FIG. 9, the negative polarity address erasing discharge in which the wall electric charges are erased from the discharge cells is produced only in the negative polarity address erasing process $WQ_D$ for only one subfield of the one field display period, as indicated by the black circles in the figure. Therefore, the wall electric charges formed by the writing address discharge produced in the positive polarity address writing process $WQ_R$ for the first subfield SF1 remain until the negative polarity address erasing discharge is produced, so that each discharge cell remains in the light emitting cell state, as indicated by the double circles in the figure. Consequently, light emissions accompanied by the sustain discharge are continuously caused in each sustain process I for each of the subfields (indicated by white circles) intervening therebetween. When the gradation driving is performed as shown in FIGS. 20 and 21 using the pixel drive data GD which can take 15 bit patterns as shown in FIG. 9, 15 types of light emissions in which the number of performing the sustain discharge in the one field (or one frame) display period is different from each other are caused to provide 15 levels of intermediate display luminance as follows:

{0, 1, 4, 9, 17, 27, 40, 56, 75, 97, 122, 150, 182, 217, 255}

Meanwhile, the pixel data PD generated by the A/D converter 3 has 8 bits and hence can express halftones with 256 levels. As such, the multi-gradation processing circuit 33 shown in FIG. 3 performs a multi-gradation processing in order to virtually realize a halftone display with 256 levels even with the 15-level gradation driving.

In the driving method described above, since the reset discharge for producing a discharge in the entire discharge cells is not performed in order to equalize the wall electric charged in the entire discharge cells, the dark contrast when displaying dark images is improved.

In the driving method shown in FIG. 21, a discharge (the writing address discharge) is produced between the row electrodes Y of a negative polarity and the column electrodes D of a positive polarity in the positive polarity address writing process $WQ_R$ for the first subfield SF1. In this way, the discharge (the writing address discharge) can be securely produced in the positive polarity address writing process $WQ_R$ for the first subfield SF1, even in a case where the erasing discharge for charging the row electrodes Y to the positive polarity and the column electrodes D to the negative polarity is performed in the erasing process EQ for the first subfield SF14 at a period immediately before the first subfield SF1.

Hereinafter, the reason why the discharge (the writing address discharge) can be securely produced in the positive polarity address writing process $WQ_R$ will be described.

Figure 22A:
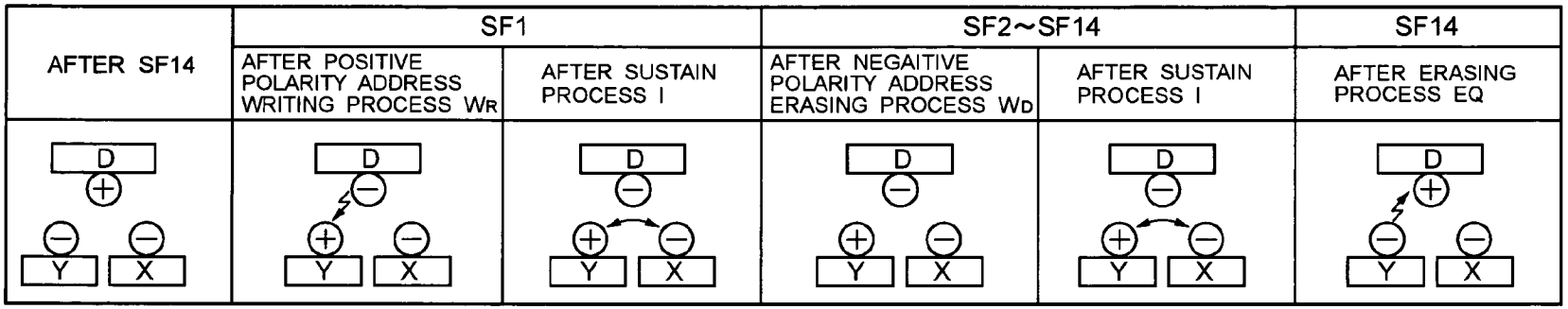
FIGS. 22A to 22C are schematic diagrams showing the polarity changes in the electric charges formed on the column electrodes D and the row electrodes X and Y in each discharge cell in the unit display period, which is driven in accordance with those light emission driving format, driving pulses, and timings as shown in FIGS. 20 and 21.
Figure 22B:
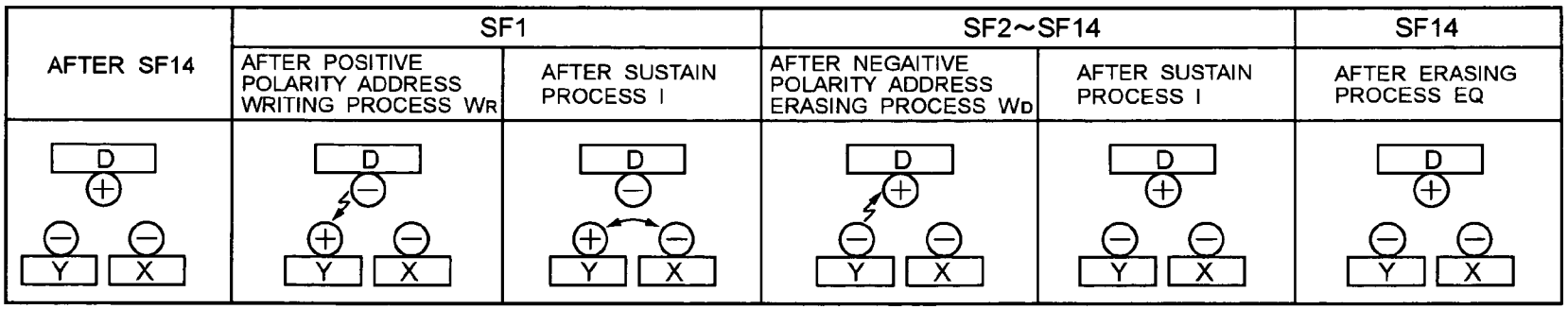
Figure 22C:
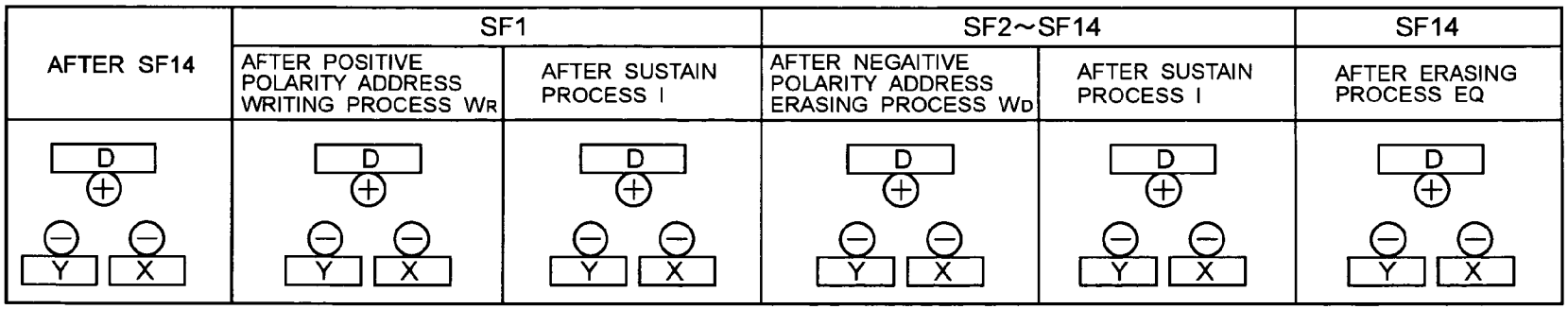

FIGS. 22A to 22C are schematic diagrams showing polarity changes in electric charges formed on the column electrodes D and the row electrodes X and Y in each discharge cell in the unit display period (subfields SF1 to SF14).

FIG. 22A shows the polarity changes in electric charges in the discharge cells in the case of the 15-level gradation driving scheme for expressing the highest luminance level as shown in FIG. 9.

In FIG. 22A, at a period immediately before the first subfield SF1, i.e., at a period after performing the erasing process E for the first subfield SF14, negative polarity charges are formed in the vicinity of the row electrodes X and Y, and positive polarity charges are formed in the vicinity of the column electrodes D. In this event, since the electric charges formed on the row electrodes X and Y have the same (negative) polarity, the discharge cells are in the non-light emitting cell state.

Next, in the positive polarity address writing process $WQ_R$ for the first subfield SF1, as shown in FIG. 21, an writing address discharge is produced between the row electrodes Y and the column electrodes D in the discharge cells, in a state that the column electrodes D in the discharge cells are charged to a positive polarity in accordance with the supply of the scan pulses $SP_W$ of a negative polarity voltage to the row electrodes Y and the pixel data pulses RDP of a positive polarity voltage to the column electrodes D. In this way, in the discharge cells, negative electric charges are formed in the vicinity of the row electrodes X, positive electric charges are formed in the vicinity of the row electrodes Y, and negative electric charges are formed in the vicinity of the column electrodes D, respectively. In this event, since the electric charges formed on the row electrodes X and Y have a different polarity, the discharge cells are in the light emitting cell state.

Next, in the sustain process I for the first subfield SF1, the sustain discharge is produced between the row electrodes X and the row electrodes Y in the discharge cells whenever the sustain pulses IP of a positive polarity voltage are alternately supplied to the row electrodes X and Y in this order. In this event, the sustain pulses $IP_X$ are the last one among the sustain pulses $IP_X$ and $IP_Y$ supplied to the row electrodes X and Y in the sustain process I. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. In this event, since the electric charges formed on the row electrodes X and Y have a different polarity, the discharge cells are in the light emitting cell state.

In this case, as shown in FIG. 9, in the 15-level gradation driving scheme, the erasing address discharge (indicated by the dark circles) is not produced in the negative polarity address erasing process $WQ_D$ for any one subfield of the SF2 to SF14 and the discharge cells maintain their light emitting cell states for those periods.

Therefore, in the sustain process I for each of the subfields SF2 to SF14, the sustain discharge is produced between the row electrodes X and the row electrodes Y in the discharge cells whenever the sustain pulses IP are supplied thereto. In this event, the sustain pulses $IP_X$ are the last one among the sustain pulses $IP_X$ and $IP_Y$ supplied to the row electrodes X and Y in the sustain process I for each of the subfields SF2 to SF14. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. In this event, since the electric charges formed on the row electrodes X and Y have a different polarity, the discharge cells are in the light emitting cell state.

In the erasing process EQ for the last subfield SF14, the erasing discharge is produced between the row electrodes Y and the column electrodes D in the discharge cells in accordance with the supply of the erasing pulses EP of a positive polarity voltage to the row electrodes Y, whereby negative electric charges are formed in the vicinity of the row electrodes Y. Therefore, at a period after performing the erasing process EQ for the first subfield SF14, in the discharge cells, negative electric charges are formed in the vicinity of the row electrodes X and Y, and positive electric charges are formed in the vicinity of the column electrodes D. In this event, since the electric charges formed in the row electrodes X and Y have the same polarity, the discharge cells are in the non-light emitting cell state.

FIG. 22B shows the polarity changes in electric charges in the discharge cells in the case of the second to 14-th level gradation driving scheme as shown in FIG. 9.

In FIG. 22B, at a period immediately before the first subfield SF1, i.e., at a period after performing the erasing process EQ for the first subfield SF14, negative polarity charges are formed in the vicinity of the row electrodes X and Y, and positive polarity charges are formed in the vicinity of the column electrodes D. In this event, since the electric charges formed on the row electrodes X and Y have the same polarity (negative polarity), the discharge cells are in the non-light emitting cell state.

Next, in the negative polarity address writing process $WQ_R$ for the first subfield SF1, as shown in FIG. 21, a writing address discharge is produced between the row electrodes Y and the column electrodes D in the discharge cells, in a state that the column electrodes D in the discharge cells are charged to a positive polarity in accordance with the supply of the scan pulses $SP_W$ of a negative polarity voltage to the row electrodes Y and the pixel data pulses RDP of a positive polarity voltage to the column electrodes D. In this way, in the discharge cells, negative electric charges are formed in the vicinity of the row electrodes X, positive electric charges are formed in the vicinity of the row electrodes Y, and negative electric charges are formed in the vicinity of the column electrodes D, respectively. In this event, since the electric charges formed on the row electrodes X and Y have a different polarity, the discharge cells are in the light emitting cell state.

Next, in the sustain process I for the first subfield SF1, the sustain discharge is produced between the row electrodes X and the row electrodes Y in the discharge cells whenever the sustain pulses IP are supplied thereto. In this event, the sustain pulses $IP_X$ are the last one among the sustain pulses $IP_X$ and $IP_Y$ supplied to the row electrodes X and Y in the sustain process I. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. In this event, since the electric charges formed on the row electrodes X and Y have a different polarity, the discharge cells are in the light emitting cell state.

In this case, as shown in FIG. 9, in the second to 14-th level gradation driving scheme, the erasing address discharge (indicated by the dark circles) is produced in the negative polarity address erasing process $WQ_D$ for one subfield of the SF2 to SF14. That is, in the negative polarity address erasing process $WQ_D$ for the one subfield of the SF2 to SF14, as shown in FIG. 21, an erasing address discharge is produced between the row electrodes Y and the column electrodes D in the discharge cells, in a state that the column electrodes D in the discharge cells are charged to a negative polarity in accordance with the supply of the scan pulses $SP_D$ of a positive polarity voltage to the row electrodes Y and the pixel data pulses DP of the 0 voltage to the column electrodes D. In this way, in the discharge cells, negative electric charges are formed in the vicinity of the row electrodes X and Y, and positive electric charges are formed in the vicinity of the column electrodes D. In this event, since the electric charges formed on the row electrodes X and Y have the same polarity, the discharge cells are in the non-light emitting cell state.

Therefore, in the sustain process I for each of the subfields SF2 to SF14 at a period immediately before the production of the erasing address discharge, the sustain discharge is produced between the row electrodes X and the row electrodes Y in the discharge cells whenever the sustain pulses IP are supplied thereto. In this event, the sustain pulses $IP_X$ are the last one among the sustain pulses $IP_X$ and $IP_Y$ supplied to the row electrodes X and Y in the sustain process I for each subfield. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. In this event, since the electric charges formed on the row electrodes X and Y have a different polarity, the discharge cells are in the light emitting cell state.

Meanwhile, in the sustain process I for the subfield at which the erasing address discharge is produced and subsequent subfields, the sustain discharge is not produced even when the sustain pulses IP of a positive polarity voltage are alternately supplied to the row electrodes X and Y in this order. Therefore, at a period after performing the sustain process I for each subfield, in the discharge cells, negative electric charges are formed in the vicinity of the row electrodes X and Y, and positive electric charges are formed in the vicinity of the column electrodes D, respectively. In this event, since the electric charges formed in the row electrodes X and Y have the same polarity, the discharge cells are in the non-light emitting cell state.

In the erasing process EQ for the last subfield SF14, since the same negative electric charges are formed in the vicinity of the row electrodes X and Y, the erasing discharge is not produced even when the erasing pulses EP of a positive polarity voltage are supplied to the row electrodes Y. Therefore, at a period after performing the erasing process EQ, in the discharge cells, the same negative electric charges remain in the vicinity of the row electrodes X and Y, and positive electric charges remain in the vicinity of the column electrodes D.

FIG. 22C shows the polarity changes in electric charges in the discharge cells in the case of the first level gradation driving scheme for expressing the lowest luminance level (black luminance level) as shown in FIG. 9.

In FIG. 22C, at a period immediately before the first subfield SF1, i.e., at a period after performing the erasing process E for the first subfield SF14, negative polarity charges are formed in the vicinity of the row electrodes X and Y, and positive polarity charges are formed in the vicinity of the column electrodes D. In this event, since the electric charges formed on the row electrodes X and Y have the same (negative) polarity, the discharge cells are in the non-light emitting cell state. Here, in the first level gradation driving scheme for expressing the lowest luminance level (black luminance level), the discharge is not produced in any subfield of the SF1 to SF14, as shown in FIG. 9. Therefore, as shown in FIG. 22C, in a period from the first subfield SF1 to the first subfield SF14, the discharge cells maintain their cell states they originally had in a period immediately before the first subfield SF1 is maintained: that is, in the discharge cells, the same negative electric charges are formed in the vicinity of the row electrodes X and Y, and the positive electric charges are formed in the vicinity of the column electrodes D.

As described above, in the driving method shown in FIG. 21, in order to selectively set the discharge cells to the light emitting cell state in accordance with the pixel data only in the first subfield SF1, a discharge (a writing address discharge) for forming wall electric charges is produced by supplying the positive polarity voltage to the column electrodes D and the negative polarity voltage to the row electrodes Y, respectively. Therefore, since, in order to produce the erasing discharge only in those discharge cells having wall electric charges remaining thereon, in the erasing process EQ for the last subfield SF14, a positive polarity voltage higher than that supplied to the column electrodes D is supplied to the row electrodes Y, it is possible to securely produce the writing address discharge even in the presence of the negative electric charges in the vicinity of the row electrodes Y.

According to the embodiment shown in FIG. 21, in the negative polarity address erasing process $WQ_D$ for each of the subfields SF2 to SF14, the erasing address discharge is produced between the row electrodes Y and the column electrodes D by supplying the 0 voltage to the column electrodes D during the supply of the positive polarity scan pulse $SP_D$ to the row electrodes Y.

However, when producing the erasing address discharge in the negative polarity address erasing process $WQ_D$, the voltage supplied to the column electrodes D need not always be the 0 voltage but may be a negative polarity voltage. That is, the address driver 6 may generate pixel data pulses of a voltage (0 volt) in the case of the pixel drive data bits RDB with logic level "0" and generate pixel data pulses of a negative polarity voltage in the case of the pixel drive data bits RDB with logic level "1." Then, the address driver 6 groups the pixel data pulses for each display line into pixel data pulses groups $RDP_1$ to $RDP_n$ and sequentially supplies them to the column electrodes $D_1$ to $D_m$ of the PDP 10. In this event, the erasing address discharge as described above is produced in those discharge cells at intersections of the row electrodes Y supplied with the positive polarity scan pulses $SP_D$ and the columns electrodes D supplied with the pixel data pulses of the negative polarity voltage. Meanwhile, the erasing address discharge is not produced in those discharge cells supplied with the pixel data pulses of the 0 voltage and the positive polarity scan pulses $SP_D$. In this case, as the peak voltage of the scan pulses $SP_D$, a voltage at which the discharge may not be produced even in the case of the column electrodes D of the 0 voltage is used.

In the driving method shown in FIGS. 20 and 21, although the erasing process EQ performed in the last subfield SF14 is configured to produce the erasing discharge only in those discharge cells having wall electric charges remaining thereon and remove the wall electric charges, the invention may be applied to a case where the erasing process EQ is not performed.

Figure 23:
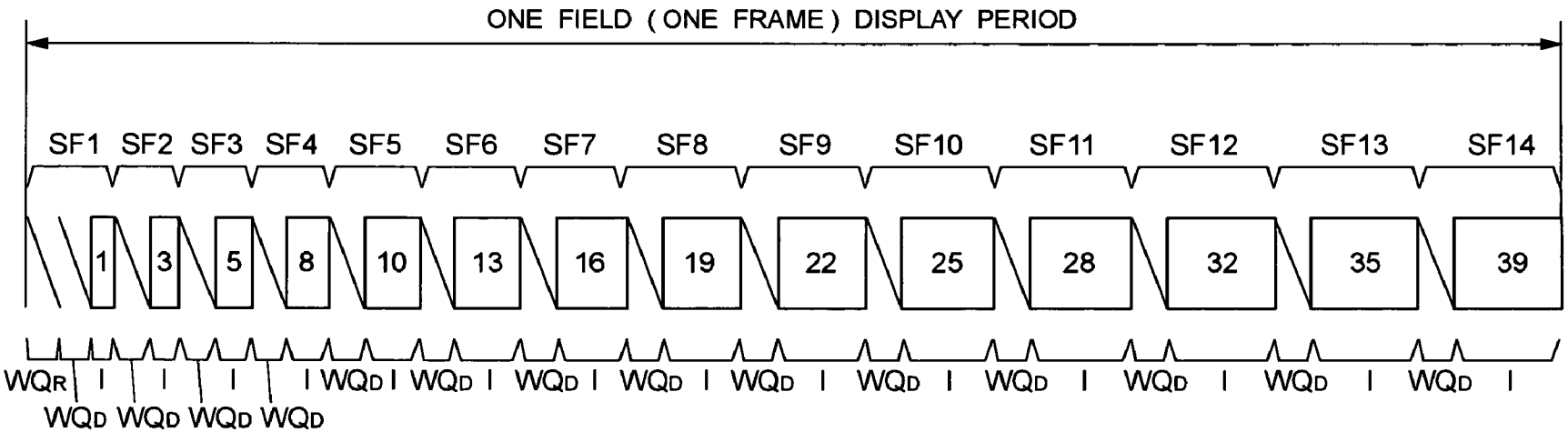
FIG. 23 is a diagram showing a modified example of the light emission driving format shown in FIG. 20.

FIG. 23 is a diagram showing a modified example of the light emission driving format shown in FIG. 20, which has been made in view of the above-mentioned matters.

In the light emission driving format shown in FIG. 23, similar to that shown in FIG. 20, one field (or one frame) display period is divided into 14 subfields SF1 to SF14, and a negative polarity address erasing process $WQ_D$ and a sustain process I are sequentially performed in each of the subfields SF2 to SF14. However, in the light emission driving format shown in FIG. 23, the erasing process EQ is not included in the last subfield SF14. In addition, in the first subfield SF1, the sustain process I is performed after the negative polarity address erasing process $WQ_D$ immediately after the positive polarity address writing process $WQ_R$.

Figure 24:
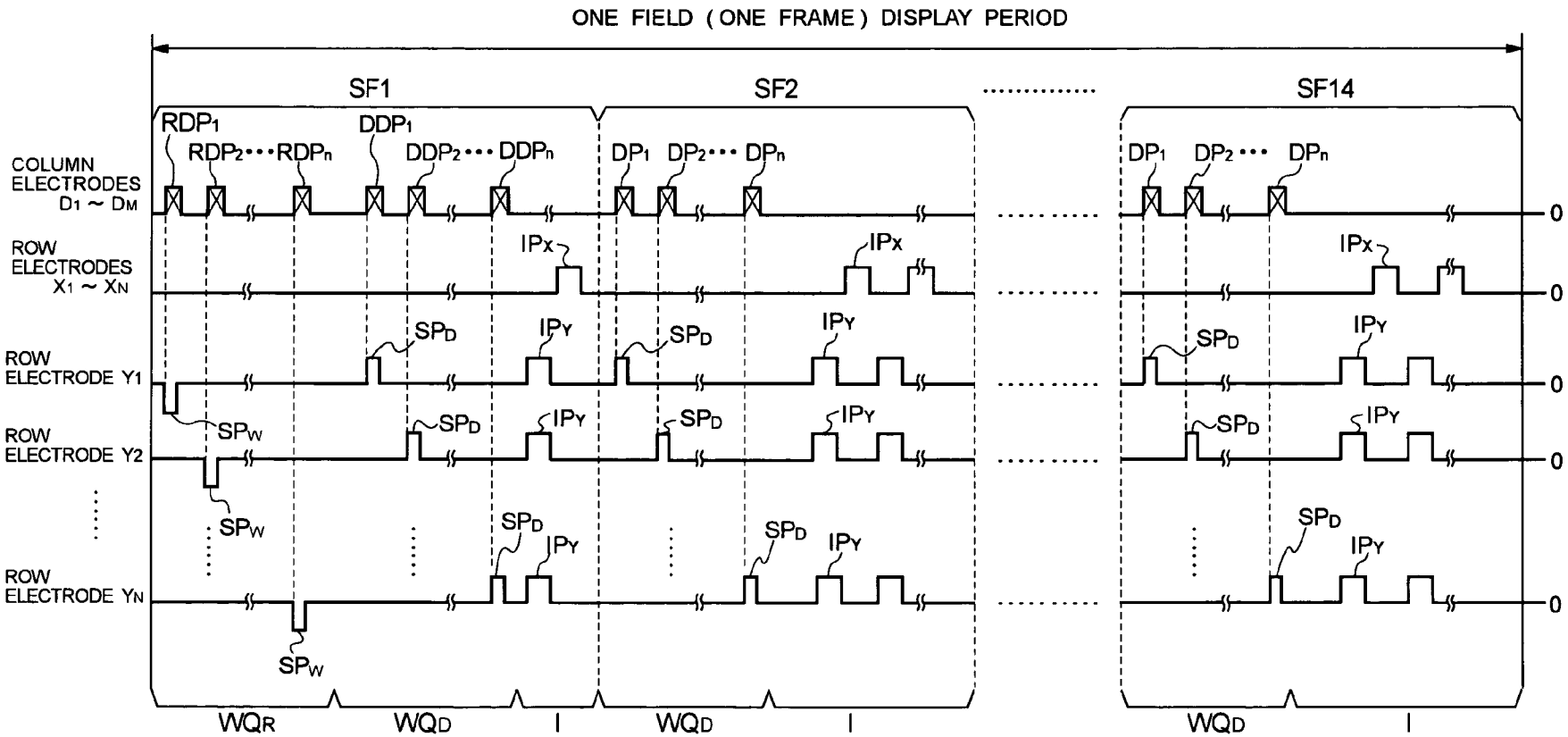
FIG. 24 is a diagram showing a further example of the various driving pulses supplied to the PDP 10 in accordance with the light emission driving format shown in FIG. 23, and timings at which the driving pulses are supplied.

FIG. 24 is a diagram showing various driving pulses supplied by each of the address driver 6, first sustain driver 7 and second sustain driver 8 to the column electrodes and row electrode pairs of the PDP 10 in accordance with the light emission driving format shown in FIG. 23, and timings at which the driving pulses are supplied.

In FIG. 24, in the positive polarity address writing process $WQ_R$ performed only for the first subfield SF1, the address driver 6 generates pixel data pulses having peak voltages corresponding to the pixel drive data bits $RDB_{(1, 1)}$ to $RDB_{(n, m)}$ read out from the memory 4. For example, the address driver 6 generates pixel data pulses having peak voltages of a positive polarity in the case of the pixel drive data bits RDB with logic level "0" and generates pixel data pulses of a low voltage (0 volt) in the case of the pixel drive data bits RDB with logic level "1." Then, the address driver 6 groups the pixel data pulses for each display line into pixel data pulses groups $RDP_1$ to $RDP_n$ and sequentially supplies them to the column electrodes $D_1$ to $D_m$ of the PDP 10, as shown in FIG. 24. Further, in the positive polarity address writing process $WQ_R$, the second sustain driver 8 generates a negative polarity scan pulses $SP_W$ in synchronization with the supply of the pixel data pulses groups $RDP_1$ to $RDP_n$ and sequentially supplies the scanning pulse $SP_W$ to the row electrodes $Y_1$ to $Y_n$, as shown in FIG. 24. In this event, a writing address discharge is produced only in those discharge cells at intersections of the row electrodes Y supplied with the negative polarity scan pulses $SP_W$ and the columns electrodes D supplied with the pixel data pulses having peak voltages of a positive polarity. In this way, wall electric charges are formed in the discharge cells in which the writing address discharge is produced, and the discharge cells are set to the light emitting cell state. Meanwhile, the writing address discharge as described above is not produced in those discharge cells supplied with the pixel data pulses of the 0 voltage and the scan pulses $SP_W$. Therefore, the wall electric charges are not formed in the discharge cells, and the discharge cells are set to the non-light emitting cell state.

Next, in the negative polarity address erasing process $WQ_D$ performed in the first subfield SF1 at a period immediately after the positive polarity address writing process $WQ_R$, the address driver 6 generates pixel data pulses having peak voltages corresponding to the pixel drive data bits $RDB_{(1, 1)}$ to $RDB_{(n, m)}$ read out from the memory 4. For example, the address driver 6 generates pixel data pulses having peak voltages of a positive polarity in the case of the pixel drive data bits RDB with logic level "0" and generates pixel data pulses having peak voltages of the 0 voltage in the case of the pixel drive data bits RDB with logic level "1." Then, the address driver 6 groups the pixel data pulses for each display line into pixel data pulses groups $DDP_1$ to $DDP_n$ and sequentially supplies them to the column electrodes $D_1$ to $D_m$ of the PDP 10, as shown in FIG. 24. Further, in the negative polarity address erasing process $WQ_D$, the second sustain driver 8 generates a positive polarity scan pulses $SP_D$ in synchronization with the supply of the pixel data pulses groups $DDP_1$ to $DDP_n$ and sequentially supplies the scanning pulse $SP_D$ to the row electrodes $Y_1$ to $Y_n$, as shown in FIG. 24. In this event, an erasing address discharge is produced only in those discharge cells at intersections of the row electrodes Y supplied with the positive polarity scan pulses $SP_D$ and the columns electrodes D supplied with the pixel data pulses of the 0 voltage. That is, the erasing address discharge is produced between the row electrodes Y and the column electrodes D in the discharge cells, in a state that the row electrodes Y are charged to a positive polarity and the column electrodes D serving as the address electrodes are charged to a negative polarity. Meanwhile, since the erasing address discharge as described above is not produced in those discharge cells supplied with the pixel data pulses having peak voltages of a positive polarity and the scan pulses $SP_D$, the discharge cells maintain their cell states. That is, the discharge cells remain in the light emitting cell state in the case of the presence of the wall electric charges and remain in the non-light emitting cell state in the case of the absence of the wall electric charges.

That is, as shown in FIG. 9, in the first subfield SF1, the erasing address discharge is produced in the negative polarity address erasing process $WQ_D$ in the case of the pixel drive data GD having the first bit with logic level "1", i.e., in the case the first level gradation driving scheme for expressing the lowest luminance level (black luminance level), and the writing address discharge is produced in the positive polarity address writing process $WQ_R$ in the case of expressing gradation levels other than the lowest gradation level.

The operations in the sustain process I performed for the first subfield SF1 and the negative polarity address erasing process $WQ_D$ and sustain process I performed for the subfields SF2 to SF14 are the same as those described in connection with FIGS. 20 and 21, and the descriptions thereof will be omitted.

Here, in the driving method shown in FIGS. 23 and 24, the erasing process EQ is not performed in the last subfield SF14 immediately after the sustain process I. Therefore, at a period immediately before the first subfield SF1, those discharge cells having wall electric charges remaining thereon coexist with those discharge cells having no wall electric charges remaining thereon.

Figure 25A:
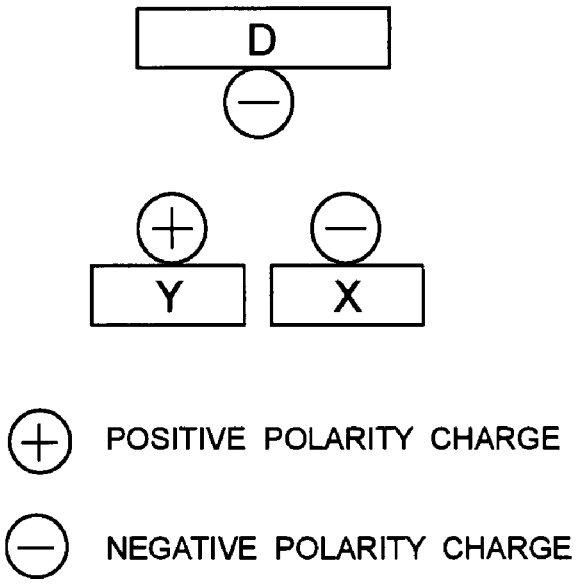
FIGS. 25A and 25B are schematic diagrams showing the charge formation state in the discharge cells at a period immediately before the first subfield SF1.
Figure 25B:
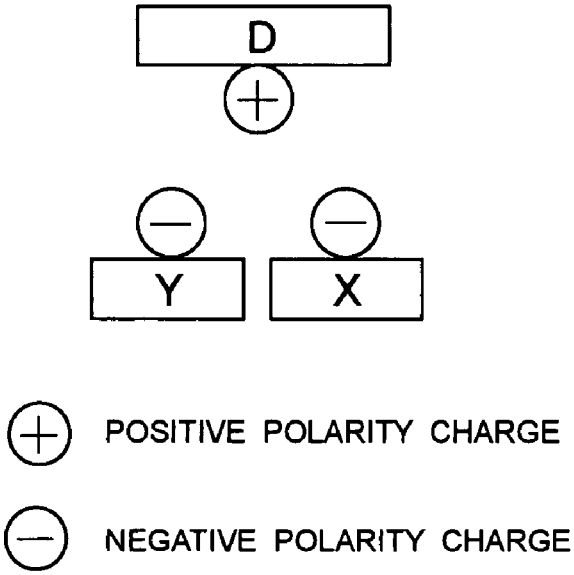

In this event, in those discharge cells in their light emitting cell states, negative electric charges are formed on the row electrodes X, positive electric charges are formed on the row electrodes Y, and negative electric charges are formed on the column electrodes D, as shown in FIG. 25A. Meanwhile, in those discharge cells in their non-light emitting cell states, the same negative electric charges are formed on the row electrodes X and Y, and positive electric charges are formed on the column electrodes D, as shown in FIG. 25B.

FIGS. 26A to 26C are schematic diagrams showing the polarity changes in the electric charges formed on the column electrodes D and the row electrodes X and Y in each discharge cell in the unit display period in a case where the discharge cells are in the light emitting cell state as shown in FIG. 25A at a period immediately before the first subfield SF1.

FIG. 26A shows the polarity changes in electric charges in the discharge cells in the case of the 15-level gradation driving scheme for expressing the highest luminance level as shown in FIG. 9.

In the 15-level gradation driving scheme, in order to produce the writing address discharge (indicated by the double circles) in the first subfield SF1 as shown in FIG. 9, in the positive polarity address writing process $WQ_R$, the scan pulses $SP_W$ of a negative polarity voltage are supplied to the row electrodes Y and the pixel data pulses RDP of a positive polarity voltage is supplied to the column electrodes D. However, in this event, since the discharge cells are in the light emitting cell state as shown in FIG. 25A (i.e., since positive electric charges are formed on the row electrodes Y and negative electric charges are formed on the column electrodes D), the writing address discharge is not produced in the discharge cells. Therefore, even after performing the positive polarity address writing process $WQ_R$ in the first subfield SF1, the positive electric charges remain in the row electrodes Y, the negative electric charges remain in the row electrodes X, and the negative electric charges remain in the column electrodes D, respectively, as shown in FIG. 25A. Subsequently, in the negative polarity address erasing process $WQ_D$ for the first subfield SF1, the scan pulses $SP_D$ of a positive polarity voltage are supplied to the row electrodes Y and the pixel data pulses RDP of a positive polarity voltage are supplied to the column electrodes D. Therefore, the discharge is not produced in the negative polarity address erasing process $WQ_D$ and, even after the negative polarity address erasing process $WQ_D$, the positive electric charges remain in the row electrodes Y, the negative electric charges remain in the row electrodes X, and the negative electric charges remain in the column electrodes D. In the sustain process I for each of the subfields SF1 to SF14, the sustain discharge is produced between the row electrodes X and the row electrodes Y in the discharge cells whenever the sustain pulses IP of a positive polarity voltage are supplied. In this event, the sustain pulses $IP_X$ are the last one among the sustain pulses $IP_X$ and $IP_Y$ supplied to the row electrodes X and Y in the sustain process I. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. That is, according to the 15-level gradation driving scheme, at a period immediately after performing the sustain process I for the last subfield SF14, in the discharge cells, negative electric charges remain in the vicinity of the row electrodes X, positive electric charges remain in the vicinity of the row electrodes Y, and negative electric charges remain in the vicinity of the column electrodes D, as shown in FIG. 26A.

FIG. 26B shows the polarity changes in electric charges in the discharge cells in the case of the second to 14-th level gradation driving scheme as shown in FIG. 9.

In the gradation driving scheme, in order to produce the writing address discharge (indicated by the double circles) in the first subfield SF1 as shown in FIG. 9, in the positive polarity address writing process $WQ_R$, the scan pulses $SP_W$ of a negative polarity voltage are supplied to the row electrodes Y and the pixel data pulses of a positive polarity voltage is supplied to the column electrodes D. However, in this event, since the discharge cells are in the light emitting cell state as shown in FIG. 25A, (i.e., since positive electric charges are formed on the row electrodes Y and negative electric charges are formed on the column electrodes D), the writing address discharge is not produced in the discharge cells. Therefore, even after performing the positive polarity address writing process $WQ_R$ in the first subfield SF1, the positive electric charges remain in the row electrodes Y, the negative electric charges remain in the row electrodes X, and the negative electric charges remain in the column electrodes D, as shown in FIG. 26B. Subsequently, in the negative polarity address erasing process $WQ_D$ for the first subfield SF1, the scan pulses $SP_D$ of a positive polarity voltage are supplied to the row electrodes Y and the pixel data pulses of a positive polarity voltage are supplied to the column electrodes D. Therefore, the discharge is not produced in the negative polarity address erasing process $WQ_D$ and, even at a period immediately after the negative polarity address erasing process $WQ_D$, the positive electric charges remain in the row electrodes Y, the negative electric charges remain in the row electrodes X, and the negative electric charges remain in the column electrodes D. In the sustain process I for the first subfield SF1, the sustain discharge is produced between the row electrodes X and the row electrodes Y in the discharge cells whenever the sustain pulses IP of a positive polarity voltage are alternately supplied to the row electrodes X and Y. In this event, the sustain pulses $IP_X$ are the last one among the sustain pulses $IP_X$ and $IP_Y$ supplied to the row electrodes X and Y in the sustain process I. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. In this case, as shown in FIG. 9, in the second to 14-th level gradation driving scheme, the erasing address discharge (indicated by the dark circles) is produced in the negative polarity address erasing process $WQ_D$ for one subfield of the SF2 to SF14. That is, in the negative polarity address erasing process $WQ_D$ for the one subfield of the SF2 to SF14, an erasing address discharge is produced between the row electrodes Y and the column electrodes D in the discharge cells, in a state that the column electrodes D in the discharge cells are charged to a negative polarity in accordance with the supply of the scan pulses $SP_D$ of a positive polarity voltage to the row electrodes Y and the pixel data pulses of the 0 voltage to the column electrodes D. In this way, at a period after performing the negative polarity address erasing process $WQ_D$ in the one subfield, in the discharge cells, the same negative electric charges are formed in the vicinity of the row electrodes X and Y, and positive electric charges are formed in the vicinity of the column electrodes D. In this event, since the electric charges formed on the row electrodes X and Y have the same polarity, the discharge cells are in the non-light emitting cell state. Therefore, in the sustain process I for each of the subfields SF2 to SF14 at a period immediately before the production of the erasing address discharge, the sustain discharge is produced between the row electrodes X and the row electrodes Y in the discharge cells whenever the sustain pulses IP of a positive polarity voltage are alternately supplied to the row electrodes X and Y in this order. In this event, the sustain pulses $IP_X$ are the last one among the sustain pulses $IP_X$ and $IP_Y$ supplied to the row electrodes X and Y in the sustain process I for each subfield. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. Meanwhile, in the sustain process I for the subfield at which the erasing address discharge is produced and subsequent subfields, the sustain discharge is not produced even when the sustain pulses IP of a positive polarity voltage are alternately supplied to the row electrodes X and Y in this order. Therefore, at a period after performing the sustain process I for each subfield, in the discharge cells, negative electric charges are formed in the vicinity of the row electrodes X and Y, and positive electric charges are formed in the vicinity of the column electrodes D, as shown in FIG. 26B.

FIG. 26C shows the polarity changes in electric charges in the discharge cells in the case of the first level gradation driving scheme for expressing the lowest luminance level (black luminance level) as shown in FIG. 9.

In the first level gradation driving scheme, in the positive polarity address writing process $WQ_R$ for the first subfield SF1, the scan pulses $SP_W$ of a negative polarity voltage are supplied to the row electrodes Y and the pixel data pulses of the 0 voltage is supplied to the column electrodes D. Therefore, the writing address discharge is not produced in the positive polarity address writing process $WQ_R$ and, even after the positive polarity address writing process $WQ_R$, the positive electric charges remain in the row electrodes Y, the negative electric charges remain in the row electrodes X, and the negative electric charges remain in the column electrodes D, as shown in FIG. 26C. Subsequently, in the negative polarity address erasing process $WQ_D$ for the first subfield SF1, the scan pulses $SP_D$ of a positive polarity voltage are supplied to the row electrodes Y and the pixel data pulses of the 0 voltage are supplied to the column electrodes D. Therefore, in the negative polarity address erasing process $WQ_D$, the address erasing discharge is produced between the row electrodes Y and the column electrodes D in a state that the row electrodes Y are charged to a positive polarity and the column electrodes D are charged to a negative polarity. In this way, at a period after performing the negative polarity address erasing process $WQ_D$ in the first subfield SF1, the discharge cells are set to the non-light emitting cell state in which the same negative electric charges are formed on the row electrodes X and Y and the positive electric charges are formed on the column electrodes D. Therefore, since the discharge is not produced in a period after performing the negative polarity address erasing process $WQ_D$ in the first subfield SF1, the discharge cells maintain their non-light emitting cell states until the last subfield SF14, as shown in FIG. 25B. That is, the same negative electric charges remain in the row electrodes X and Y and the positive electric charges remain in the column electrodes D.

Figure 27A:
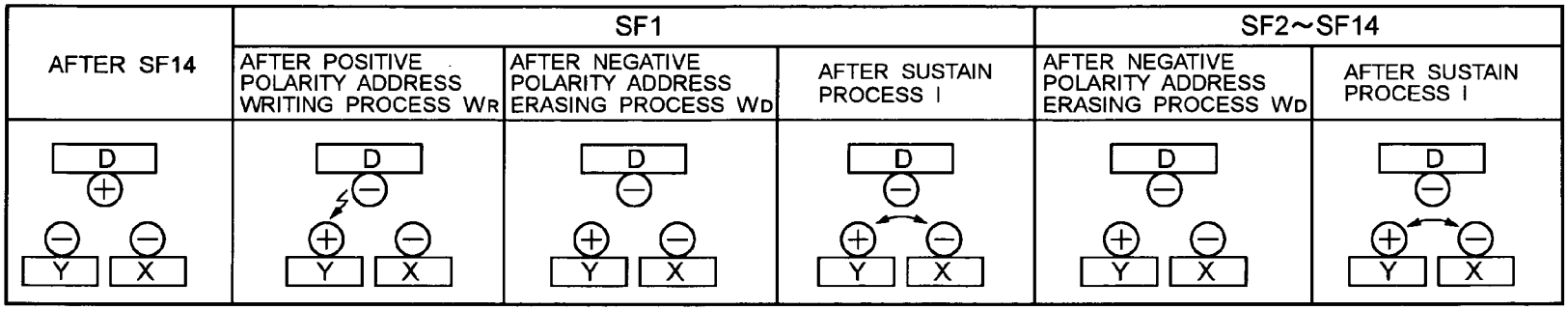
FIGS. 27A to 27C are schematic diagrams showing the polarity changes in the electric charges formed on the column electrodes D and the row electrodes X and Y in each discharge cell in a case where the discharge cells are in the charge formation state as shown in FIG. 25B at a period immediately before the first subfield SF1, which is driven in accordance with those light emission driving format, driving pulses, and timings as shown in FIGS. 23 and 24.
Figure 27B:
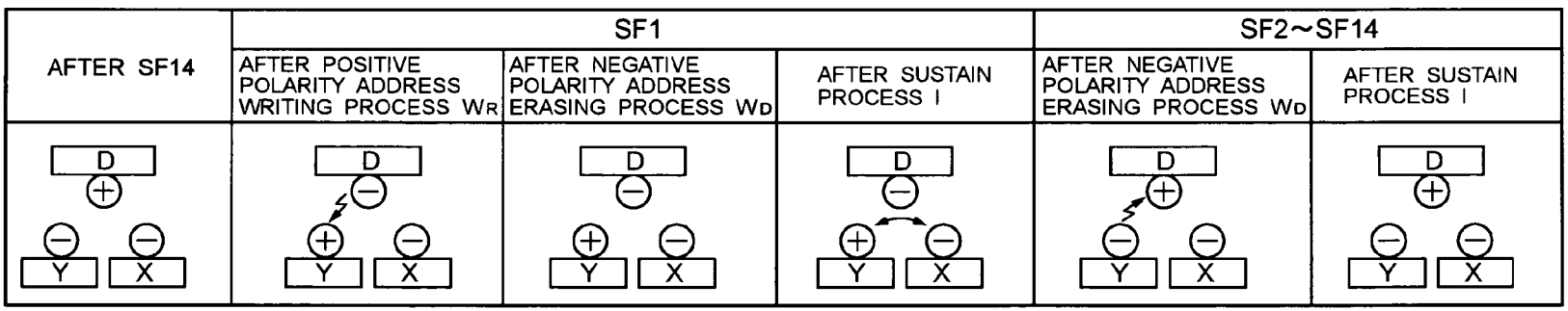
Figure 27C:
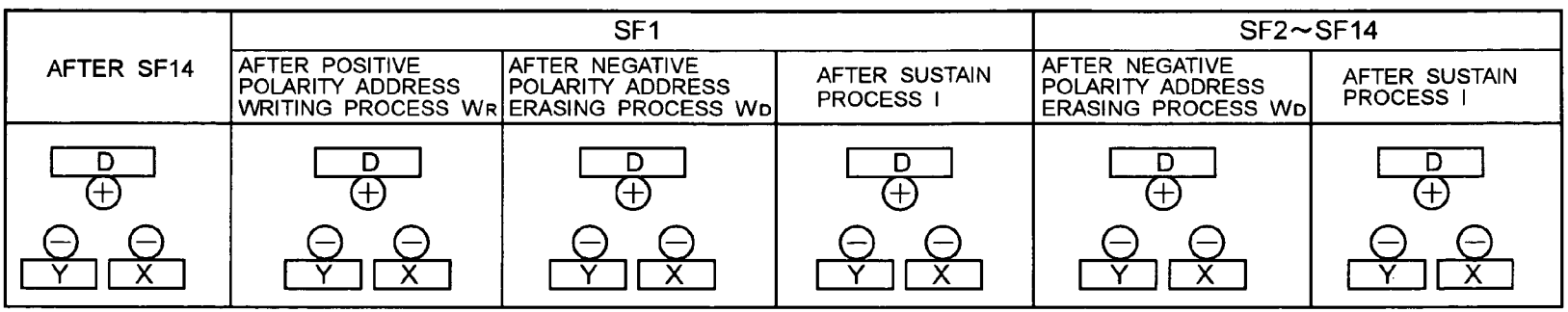

FIGS. 27A to 27C are schematic diagrams showing the polarity changes in the electric charges formed on the column electrodes D and the row electrodes X and Y in each discharge cell in a case where the discharge cells are in the non-light emitting cell state as shown in FIG. 25B at a period immediately before the first subfield SF1.

FIG. 27A shows the polarity changes in electric charges in the discharge cells in the case of the 15-level gradation driving scheme for expressing the highest luminance level as shown in FIG. 9.

In the 15-level gradation driving scheme, in order to produce the writing address discharge (indicated by the double circles) in the first subfield SF1 as shown in FIG. 9, in the positive polarity address writing process $WQ_R$, the scan pulses $SP_W$ of a negative polarity voltage are supplied to the row electrodes Y and the pixel data pulses of a positive polarity voltage is supplied to the column electrodes D. In this event, since the discharge cells are in the non-light emitting cell state as shown in FIG. 25B, (i.e., since the same negative electric charges are formed on the row electrodes X and Y and positive electric charges are formed on the column electrodes D), the writing address discharge is produced between the row electrodes Y and the column electrodes D in a state that the column electrodes D is charged to a positive polarity. Therefore, at a period after performing the positive polarity address writing process $WQ_R$ in the first subfield SF1, the positive electric charges remain in the row electrodes Y, the negative electric charges remain in the row electrodes X, and the negative electric charges remain in the column electrodes D, respectively, as shown in FIG. 27A. Subsequently, in the negative polarity address erasing process $WQ_D$ for the first subfield SF1, the scan pulses $SP_D$ of a positive polarity voltage are supplied to the row electrodes Y and the pixel data pulses of the positive polarity voltage are supplied to the column electrodes D. Therefore, the discharge is not produced in the negative polarity address erasing process $WQ_D$ and, even after the negative polarity address erasing process $WQ_D$, the positive electric charges remain in the row electrodes Y, the negative electric charges remain in the row electrodes X, and the negative electric charges remain in the column electrodes D. In the sustain process I for each of the subfields SF1 to SF14, the sustain discharge is produced between the row electrodes X and the row electrodes Y in the discharge cells whenever the sustain pulses IP of a positive polarity voltage are alternately supplied to the row electrodes X and Y. In this event, the sustain pulses $IP_X$ are the last one among the sustain pulses $IP_X$ and $IP_Y$ supplied to the row electrodes X and Y in the sustain process I. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. That is, according to the 15-level gradation driving scheme, at a period immediately after performing the sustain process I for the last subfield SF14, in the discharge cells, negative electric charges remain in the vicinity of the row electrodes X, positive electric charges remain in the vicinity of the row electrodes Y, and negative electric charges remain in the vicinity of the column electrodes D, as shown in FIG. 27A.

FIG. 27B shows the polarity changes in electric charges in the discharge cells in the case of the second to 14-th level gradation driving scheme as shown in FIG. 9.

In the gradation driving scheme, in order to produce the writing address discharge (indicated by the double circles) in the first subfield SF1 as shown in FIG. 9, in the positive polarity address writing process $WQ_R$, the scan pulses $SP_W$ of a negative polarity voltage are supplied to the row electrodes Y and the pixel data pulses of a positive polarity voltage is supplied to the column electrodes D. In this event, since the discharge cells are in the non-light emitting cell state as shown in FIG. 25B, (i.e., since the same negative electric charges are formed on the row electrodes X and Y and positive electric charges are formed on the column electrodes D), the writing address discharge is produced between the row electrodes Y and the column electrodes D in a state that the column electrodes D is charged to a positive polarity. Therefore, in a period after performing the positive polarity address writing process $WQ_R$ in the first subfield SF1, the positive electric charges remain in the row electrodes Y, the negative electric charges remain in the row electrodes X, and the negative electric charges remain in the column electrodes D, respectively, as shown in FIG. 27B. Subsequently, in the negative polarity address erasing process $WQ_D$ for the first subfield SF1, the scan pulses $SP_D$ of a positive polarity voltage are supplied to the row electrodes Y and the pixel data pulses of a positive polarity voltage are supplied to the column electrodes D. Therefore, the discharge is not produced in the negative polarity address erasing process $WQ_D$ and, even at a period immediately after the negative polarity address erasing process $WQ_D$, the positive electric charges remain in the row electrodes Y, the negative electric charges remain in the row electrodes X, and the negative electric charges remain in the column electrodes D. In the sustain process I for the first subfield SF1, the sustain discharge is produced between the row electrodes X and the row electrodes Y in the discharge cells whenever the sustain pulses IP of a positive polarity voltage are alternately supplied to the row electrodes X and Y. In this event, the sustain pulses $IP_X$ are the last one among the sustain pulses $IP_X$ and $IP_Y$ supplied to the row electrodes X and Y in the sustain process I. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. In this case, as shown in FIG. 9, in the second to 14-th level gradation driving scheme, the erasing address discharge (indicated by the dark circles) is produced in the negative polarity address erasing process $WQ_D$ for one subfield of the SF2 to SF14. That is, in the negative polarity address erasing process $WQ_D$ for the one subfield of the SF2 to SF14, an erasing address discharge is produced between the row electrodes Y and the column electrodes D in the discharge cells, in a state that the column electrodes D in the discharge cells are charged to a negative polarity in accordance with the supply of the scan pulses $SP_D$ of a positive polarity voltage to the row electrodes Y and the pixel data pulses of the 0 voltage to the column electrodes D. In this way, at a period after performing the negative polarity address erasing process $WQ_D$ in the one subfield, in the discharge cells, the same negative electric charges are formed in the vicinity of the row electrodes X and Y, and positive electric charges are formed in the vicinity of the column electrodes D. In this event, since the electric charges formed on the row electrodes X and Y have the same polarity, the discharge cells are in the non-light emitting cell state. Therefore, in the sustain process I for each of the subfields SF2 to SF14 at a period immediately before the production of the erasing address discharge, the sustain discharge is produced between the row electrodes X and the row electrodes Y in the discharge cells whenever the sustain pulses IP of a positive polarity voltage are alternately supplied to the row electrodes X and Y in this order. In this event, the sustain pulses $IP_X$ are the last one of the sustain pulses $IP_X$ and $IP_Y$ supplied to the row electrodes X and Y in the sustain process I for each subfield. Therefore, at a period after performing the sustain process I, in the discharge cells, negative electric charges are formed in the vicinity of the row electrodes X, positive electric charges are formed in the vicinity of the row electrodes Y, and negative electric charges are formed in the vicinity of the column electrodes D, respectively. Meanwhile, in the sustain process I for the subfield at which the erasing address discharge is produced and subsequent subfields, the sustain discharge is not produced even when the sustain pulses IP of a positive polarity voltage are alternately supplied to the row electrodes X and Y in this order. Therefore, at a period after performing the sustain process I for each subfield, in the discharge cells, the same negative electric charges are formed in the vicinity of the row electrodes X and Y, and positive electric charges are formed in the vicinity of the column electrodes D, as shown in FIG. 27B.

FIG. 27C shows the polarity changes in electric charges in the discharge cells in the case of the first level gradation driving scheme for expressing the lowest luminance level (black luminance level) as shown in FIG. 9.

In the first level gradation driving scheme, in the positive polarity address writing process $WQ_R$ for the first subfield SF1, the scan pulses $SP_W$ of a negative polarity voltage are supplied to the row electrodes Y and the pixel data pulses of the 0 voltage is supplied to the column electrodes D. However, the writing address discharge is not produced in the positive polarity address writing process $WQ_R$. Therefore, even after the positive polarity address writing process $WQ_R$, the discharge cells are in the non-lighting cell state in which the same negative electric charges remain in the row electrodes X and Y, and the positive electric charges remain in the column electrodes D, respectively, as shown in FIG. 27C. Subsequently, in the negative polarity address erasing process $WQ_D$ for the first subfield SF1, the scan pulses $SP_D$ of a positive polarity voltage are supplied to the row electrodes Y and the pixel data pulses of the 0 voltage are supplied to the column electrodes D. However, the address erasing discharge is not produced in the negative polarity address erasing process $WQ_D$. That is, at a period even after performing negative polarity address erasing process $WQ_D$ in the first subfield SF1, the discharge cells maintain their non-lighting cell states in which the same negative electric charges remain in the row electrodes X and Y, and the positive electric charges remain in the column electrodes D, respectively, as shown in FIG. 27C. Thereafter, the discharge cells maintain their non-light emitting cell states until the last subfield SF14, as shown in FIG. 27C. That is, the same negative electric charges remain in the row electrodes X and Y and the positive electric charges remain in the column electrodes D.

As described above, as shown in FIGS. 23 and 24, the negative polarity address erasing process $WQ_D$ is performed immediately after the positive polarity address writing process $WQ_R$ for the first subfield SF1. According to the driving method, the polarity states of electric charges of the row electrodes X and Y and the column electrodes D in the discharge cells at a period immediately before the first subfield SF1 allow various discharging operations to be securely produced even in those states shown in either FIG. 25A or FIG. 25B. That is, even when the erasing process EQ for setting the polarities of electric charges of the row electrodes X and Y and the column electrodes D in the discharge cells at a period immediately before the first subfield SF1 to those states shown in FIG. 25A is not performed, it is possible to securely produce various discharge operations and implement the display driving with an improved dark contrast.

According to the embodiment shown in FIG. 24, in the negative polarity address erasing process $WQ_D$ for each of the subfields SF2 to SF14, the erasing address discharge is produced between the row electrodes Y and the column electrodes D by supplying the 0 voltage to the column electrodes D during the supply of the positive polarity scan pulse $SP_D$ to the row electrodes Y.

However, when producing the erasing address discharge in the negative polarity address erasing process $WQ_D$, the voltage supplied to the column electrodes D need not always be the 0 voltage but may be a negative polarity voltage. That is, the address driver 6 may generate pixel data pulses of a voltage (0 volt) in the case of the pixel drive data bits RDB with logic level "0" and generate pixel data pulses of a negative polarity voltage in the case of the pixel drive data bits RDB with logic level "1." Then, the address driver 6 groups the pixel data pulses for each display line into pixel data pulses groups $RDP_1$ to $RDP_n$ and sequentially supplies them to the column electrodes $D_1$ to $D_m$ of the PDP 10. In this event, the erasing address discharge as described above is produced in those discharge cells at intersections of the row electrodes Y supplied with the positive polarity scan pulses $SP_D$ and the columns electrodes D supplied with the pixel data pulses of the negative polarity voltage. Meanwhile, the erasing address discharge is not produced in those discharge cells supplied with the pixel data pulses of the 0 voltage and the positive polarity scan pulses $SP_D$. In this case, as the peak voltage of the scan pulses $SP_D$, a voltage at which the discharge may not be produced even in the case of the column electrodes D of the 0 voltage is used.

In the embodiments described above, as shown in FIG. 9, although the 15-level gradation driving scheme is implemented in accordance with 15 types of light emission driving patterns, a 16-level gradation driving scheme (that is one level added version of the 15-level gradation driving method) may be implemented by adopting the light emission driving format shown in FIG. 23.

That is, a light emission driving pattern in which the address writing discharge and the address erasing discharge are produced only in the positive polarity address writing process $WQ_R$ and the negative address erasing process $WQ_D$ only for the first subfield SF1 of the entire subfields SF1 to SF14 is added to the 15 types of light emission driving patterns shown in FIG. 9. In this way, according to the driving method described above, since the sustain discharge is not produced in a period ranging from the first subfield SF1 to the last subfield SF14 but only the discharge accompanied by the address writing discharge and the address erasing discharge is produced, it is possible to express a luminance level corresponding to a gradation between a first level and a second level shown in FIG. 9, thereby increasing resolution for expressing a dark luminance level.

This application is based on Japanese Patent Application No. 2006-110990 which is hereby incorporated by reference.

What is claimed is:

1. A driving method of a plasma display panel to perform a gradation display in accordance with a video signal, the plasma display panel having discharge cells, functioning as pixels, at intersections of a plurality of row electrode pairs corresponding to display lines and a plurality of column electrodes arranged to intersect the row electrode pairs, the method comprising the steps of:

performing an address writing process for producing a discharge between one of the row electrode pairs and the column electrodes in the remaining discharge cells excluding those discharge cells serving to display a luminance level "0", only in the first one of a plurality of subfields constituting a unit display period of the video signal so as to set the discharge cells to a light emitting cell state;

performing, in each of the subfields, an address erasing process for selectively producing a discharge in the discharge cells in their light emitting cell states in accordance with pixel data corresponding to the video signal so as to change the states of the discharge cells to a non-light emitting cell state, and a sustain process for allowing only those discharge cells in their light emitting cell states to emit light by a number of times corresponding to the number of light emissions allocated in correspondence with a weighting factor for each of the subfields;

producing a discharge only in the discharge cells in their light emitting cell states, only in the address erasing process for one subfield selected from the subfields, so as to change the states of the discharge cells to the non-light emitting cell state; and supplying a voltage for charging the column electrodes to a negative polarity between the one of the row electrode pairs and the column electrodes, in either of the address writing process and the address erasing process, thereby producing the discharge between the one of the row electrode pairs and the column electrodes.

2. The driving method of a plasma display panel according to claim 1, wherein the address writing process is configured to produce the discharge by supplying a voltage for charging the column electrodes to one of positive and negative polarities between the one of the row electrode pairs and the column electrodes, and wherein the address erasing process is configured to produce the discharge by supplying a voltage for charging the column electrodes to the other of positive and negative polarities between the one of the row electrode pairs and the column electrodes.

3. The driving method of a plasma display panel according to claim 1, wherein the discharge produced in the address writing process allows positive polarity charges to be formed on the column electrodes in the remaining discharge cells and allows negative polarity charges to be formed on the one of the row electrode pairs in the remaining discharge cells, and wherein the discharge produced in the address erasing process allows negative polarity charges to be formed on the column electrodes and allows positive polarity charges to be formed on the one of the row electrode pairs.

4. The driving method of a plasma display panel according to claim 1, wherein the discharge produced in the address writing process allows negative polarity charges to be formed on the column electrodes and allows positive polarity charges to be formed on the one of the row electrode pairs, and wherein the discharge produced in the address erasing process allows positive polarity charges to be formed on the column electrodes and allows negative polarity charges to be formed on the one of the row electrode pairs.

5. The driving method of a plasma display panel according to claim 1, wherein an erasing process for changing the states of only those discharge cells in their light emitting cell states to the non-light emitting state is performed in the last one of the plurality of subfields constituting the unit display period.

6. The driving method of a plasma display panel according to claim 1, wherein the address erasing process is performed in each of the remaining subfields of the unit display period excluding the first subfield.

7. The driving method of a plasma display panel according to claim 1, wherein the address erasing process is performed immediately after the address writing process in the first subfield.

8. The driving method of a plasma display panel according to claim 7, wherein the address writing process and the address erasing process are configured to produce the discharge in the first subfield so that a gradation level corresponding to a high luminance level is displayed after the gradation level corresponding to the luminance level "0".

9. The driving method of a plasma display panel according to claim 1, wherein the address writing process is configured to supply a pixel date pulse of a positive polarity to the column electrodes in the discharge cells and supply a scan pulse of a positive polarity to the one of the row electrode pairs so that those discharge cells in their non-light emitting cell states remain at their non-light emitting cell states.

10. The driving method of a plasma display panel according to claim 1, wherein the address writing process is configured to supply a pixel date pulse of a negative polarity to the column electrodes in the discharge cells and supply a scan pulse of a positive polarity to the one of the row electrode pairs so that the discharge cells are set to the light emitting cell state.

11. The driving method of a plasma display panel according to claim 1, wherein the address erasing process is configured to supply a pulse of a positive polarity to the column electrodes and supply a pulse of a positive polarity to the one of the row electrode pairs so that the discharge cells remain at their light emitting cell states.

12. The driving method of a plasma display panel according to claim 1, wherein the address erasing process is configured to supply a pulse of a negative polarity to the column electrodes and supply a pulse of a positive polarity to the one of the row electrode pairs so that the discharge cells are set to the non-light emitting cell state.

13. The driving method of a plasma display panel according to claim 1, wherein the discharge is not produced in the discharge cells serving to display a luminance level "0" in the unit display period.

14. The driving method of a plasma display panel according to claim 1, wherein the sustain process performed in a period ranging from the first subfield to the subfield immediately before the selected subfield is configured to allow the discharge cells to continuously emit light so as to perform the gradation display.

* * * * *